US010045126B2

(12) United States Patent
Berger et al.

(10) Patent No.: US 10,045,126 B2
(45) Date of Patent: Aug. 7, 2018

(54) MICROELECTROMECHANICAL MICROPHONE HAVING A STATIONARY INNER REGION

(71) Applicant: INVENSENSE, INC., San Jose, CA (US)

(72) Inventors: Renata Melamud Berger, Palo Alto, CA (US); Sushil Bharatan, Burlington, MA (US); Thomas Chen, Cambridge, MA (US)

(73) Assignee: INVENSENSE, INC., San Jose, CA (US)

( * ) Notice: Subject to any disclaimer, the term of this patent is extended or adjusted under 35 U.S.C. 154(b) by 303 days.

(21) Appl. No.: 14/962,182

(22) Filed: Dec. 8, 2015

(65) Prior Publication Data

US 2017/0013363 A1 Jan. 12, 2017

Related U.S. Application Data

(60) Provisional application No. 62/189,407, filed on Jul. 7, 2015.

(51) Int. Cl.
*H04R 7/20* (2006.01)
*H04R 19/04* (2006.01)
(Continued)

(52) U.S. Cl.
CPC ..... *H04R 7/20* (2013.01); *H04R 19/005* (2013.01); *H04R 19/04* (2013.01); *H04R 1/04* (2013.01)

(58) Field of Classification Search
CPC ..... H04R 7/20; H04R 19/005; H04R 19/04; H04R 1/04; H04R 7/24; H04R 31/003; H04R 2231/003; B81B 3/0051
(Continued)

(56) References Cited

U.S. PATENT DOCUMENTS 5,870,482 A * 2/1999 Loeppert ..... B81B 3/0072 381/174
8,644,528 B2 * 2/2014 Mehregany ..... H04R 19/005 381/174
(Continued)

FOREIGN PATENT DOCUMENTS

EP 1012547 B1 5/2004

OTHER PUBLICATIONS

International Search Report and Written Opinion for International Application No. PCT/US2016/042609 dated Oct. 20, 2016, 16 pages.
(Continued)

*Primary Examiner* — Oyesola C Ojo
(74) *Attorney, Agent, or Firm* — Amin, Turocy & Watson, LLP

(57) ABSTRACT

A microelectromechanical microphone has a stationary region or another type of mechanically supported region that can mitigate or avoid mechanical instabilities in the microelectromechanical microphone. The stationary region can be formed in a diaphragm of the microelectromechanical microphone by rigidly attaching, via a rigid dielectric member, an inner portion of the diaphragm to a backplate of the microelectromechanical microphone. The rigid dielectric member can extend between the backplate and the diaphragm. In certain embodiments, the dielectric member can be hollow, forming a shell that is centrosymmetric or has another type of symmetry. In other embodiments, the dielectric member can define a core-shell structure, where an outer shell of a first dielectric material defines an inner opening filled with a second dielectric material. Multiple dielectric members can rigidly attach the diaphragm to the backplate. An extended dielectric member can rigidly attach a non-planar diaphragm to a backplate.

29 Claims, 19 Drawing Sheets

(51) Int. Cl.
*H04R 19/00* (2006.01)
*H04R 1/04* (2006.01)

(58) Field of Classification Search
USPC ..... 381/174
See application file for complete search history.

(56) References Cited

U.S. PATENT DOCUMENTS 8,698,255 B2 * 4/2014 Reichenbach ..... B81B 3/0008 257/416
9,078,069 B2 * 7/2015 Bharatan ..... H04R 1/08
2007/0003082 A1 1/2007 Pedersen
2007/0047746 A1 3/2007 Weigold et al.
2009/0060232 A1 3/2009 Hirade et al.
2010/0166235 A1 * 7/2010 Zhang ..... H04R 19/04 381/174
2012/0027235 A1 2/2012 Chan et al.
2013/0177180 A1 7/2013 Bharatan et al.
2014/0084394 A1 * 3/2014 Je ..... B81B 7/0054 257/416
2014/0133685 A1 * 5/2014 Liu ..... H04R 7/20 381/355
2014/0299948 A1 * 10/2014 Wang ..... H04R 19/005 257/416
2015/0031160 A1 * 1/2015 Wang ..... H04R 31/00 438/53
2015/0078592 A1 * 3/2015 Uchida ..... H04R 19/04 381/191
2015/0109889 A1 * 4/2015 Chen ..... H04R 7/06 367/189
2015/0110302 A1 * 4/2015 Chen ..... H04R 19/005 381/162

OTHER PUBLICATIONS

Yang, "The Sensitivity Analysis of a MEMS Microphone With Different Membrane Diameters." Journal of Marine Science and Technology, vol. 18, No. 6, pp. 790-796 (2010).

* cited by examiner

MICROELECTROMECHANICAL MICROPHONE HAVING A STATIONARY INNER REGION

PRIORITY CLAIM

This patent application is a non-provisional application that claims priority to U.S. Provisional Patent Application Ser. No. 62/189,407, filed on Jul. 7, 2015, entitled "MICROMECHANICAL MICROPHONE HAVING A STATIONARY INNER REGION" the entirety of which is incorporated by reference herein.

BACKGROUND

Mechanical instability of a diaphragm in microelectromechanical microphones can be detrimental to device performance and functionality. In a microelectromechanical microphone having a large diaphragm, stress and/or large span of displacement vectors responsive to an acoustic wave can cause the diaphragm to collapse or otherwise deform either towards or away from a backplate. Therefore, capacitive signals representative of the acoustic wave can be distorted, diminishing fidelity of the microelectromechanical microphone or otherwise causing artifacts in the sensing of the acoustic wave.

SUMMARY

The following presents a simplified summary of one or more of the embodiments in order to provide a basic understanding of one or more of the embodiments. This summary is not an extensive overview of the embodiments described herein. It is intended to neither identify key or critical elements of the embodiments nor delineate any scope of embodiments or the claims. This Summary's sole purpose is to present some concepts of the embodiments in a simplified form as a prelude to the more detailed description that is presented later. It will also be appreciated that the detailed description may include additional or alternative embodiments beyond those described in the Summary section.

The present disclosure recognizes and addresses, in at least certain embodiments, the issue of buckling instability of a diaphragm in microelectromechanical microphones. The disclosure provides embodiments of microelectromechanical microphones having a stationary inner region that is acoustically inactive and provides mechanical stability. More specifically, yet not exclusively, the stationary inner region can be formed at a diaphragm of a microelectromechanical microphone via a dielectric member that rigidly attaches an inner portion of the diaphragm to a backplate of the microelectromechanical microphone.

In one embodiment, the disclosure provides a microelectromechanical microphone including a stationary plate defining multiple openings, and a movable plate defining an outer portion and an inner opening substantially centered at the geometric center of the movable plate. In certain implementations, the movable plate can be rigidly attached to the stationary plate via a hollow dielectric member extending from a surface of the stationary plate to a surface of the movable plate in a vicinity of the inner opening. A region containing an interface between with the movable plate and the hollow dielectric member is acoustically inactive.

In certain implementations, the hollow dielectric member defines a substantially centrosymmetric shell having a thickness that is about one order of magnitude less than a width of a cross-section of the substantially centrosymmetric shell. In one example, the thickness and the width of the cross-section of the substantially centrosymmetric shell can be determined at least by a material that forms the movable plate and a material that forms the hollow dielectric member.

Other embodiments and various examples, scenarios and implementations are described in more detail below. The following description and the drawings set forth certain illustrative embodiments of the specification. These embodiments are indicative, however, of but a few of the various ways in which the principles of the specification may be employed. Other advantages and novel features of the embodiments described will become apparent from the following detailed description of the specification when considered in conjunction with the drawings.

DETAILED DESCRIPTION

Figure 1:
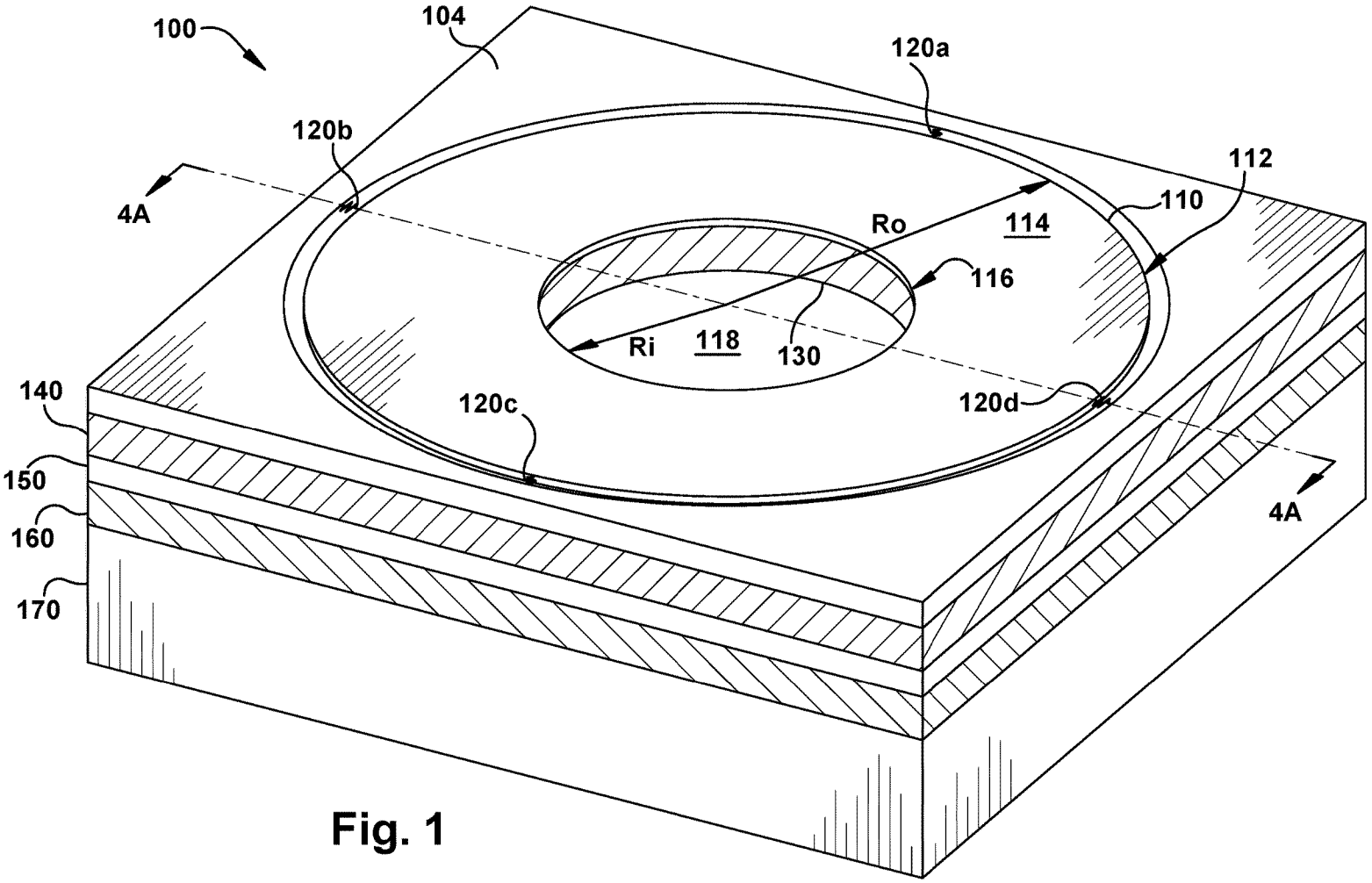
FIG. 1 illustrates an example of a microelectromechanical microphone die in accordance with one or more embodiments of the disclosure.

The disclosure recognizes and addresses, in at least certain embodiments, the issue of buckling instability of a diaphragm in microelectromechanical microphones. Without intending to be bound by theory and/or modeling, as utilized herein, "instability" refers to a sudden change in deformation mode or displacement value after which a structure does not return to its original equilibrium state, wherein such a change is responsive to any small disturbance (or perturbation) of the structure. Further, "buckling instability" refers to an instability caused by a buckling load, which is the load at which a current equilibrium state of a structural element or structure suddenly changes from stable to unstable, and simultaneously is the load at which the equilibrium state suddenly changes from that previously stable configuration to another stable configuration with or without an accompanying large response (e.g., a deformation or deflection). Thus, the buckling load is the largest load for which stability of equilibrium of a structural element or structure exists in an original equilibrium configuration. Therefore, it can be appreciated that buckling instability of the diaphragm can cause the diaphragm to collapse, causing functionality and/or performance issues in a microelectromechanical microphone. In certain scenarios, diminished performance can originate from excessive deformation or collapse due to the diaphragm and a backplate in the microelectromechanical microphone coming into physical contact. For example, sensitivity to acoustic waves and/or signal-to-noise ratio (SNR) can diminish. For another example, fidelity of an electrical representation of an acoustic wave (e.g., a wave indicative of an utterance or other type of speech) also can diminish.

Embodiments of the disclosure provide microelectromechanical microphones having a stationary region or another type of mechanically supported region that can mitigate or avoid mechanical instabilities. The stationary region can be acoustically inactive in that, for example, it can remain stationary in response to an acoustic wave impinging onto the stationary region. Yet, the mechanical stability afforded by the stationary region can permit increasing the size of a diaphragm or another type of movable plate within the microelectromechanical microphone, thus increasing sensitivity and/or fidelity. Without intending to be bound by theory and/or modeling, such mechanical stability can originate from permitting the diaphragm and a backplate to move jointly or other in a synchronized fashion, and/or from avoiding reaching critical load for a structure including the diaphragm and backplate.

As described in greater detail below, a stationary region within a microelectromechanical microphone of this disclosure can be formed within a diaphragm or other type of movable plate included in the microelectromechanical microphone. To that end, in certain embodiments, an inner portion of the diaphragm can be rigidly attached to a backplate or another type of perforated stationary plate. A rigid dielectric member extending from a surface of the backplate to a surface of the diaphragm can rigidly attach the diaphragm to the backplate. In one example, the dielectric member can be hollow, forming a shell that is centrosymmetric. In another example, the dielectric member can be hollow, and can define an inner cross-section (e.g., a circular cross-section) and an outer cross-section (e.g., an octagonal cross-section). In yet another example, the dielectric member can have a core-shell structure, where an outer shell of a first insulating material defines an inner opening filled with a second insulating material.

In certain embodiments, a diaphragm of microelectromechanical microphone of this disclosure can define an opening in the interior of the diaphragm, and the stationary region of the microphone can be formed at or near the periphery of the opening (referred to as an inner periphery). The diaphragm can include an outer region including an outer periphery. In this disclosure, the region extending between from the inner periphery to the outer periphery can be referred to as a "span" between such peripheries. In one example, the diaphragm can be annular, where an outer portion of the diagram includes an outer circular periphery having an outer radius, and the opening defines an inner circular periphery having an inner radius. As such, the span between the outer circular periphery and the inner circular periphery is determined by the inner radius and the outer radius. The disclosure is not limited to annular diaphragms, and other diaphragms having an inner portion of a first geometry (e.g., a first polygon or a circle) and an outer portion of a second geometry (e.g., a second polygon) also are contemplated. Either or both of the first geometry or the second geometry can be embodied in a circle, a square, a pentagon, a hexagon, an heptagon, an octagon, a decagon, or any other type of polygon. In other embodiments, the stationary region of a microelectromechanical microphone according to this disclosure can be defined without reliance on an opening of a diaphragm of the microphone. It should be appreciated that while embodiments of the disclosure are described with reference to a stationary backplate and a movable backplate, the disclosure is not so limited. Specifically, other embodiments of this disclosure can include a backplate and a diaphragm that are both movable, where the backplate can be more stationary (or move less) than the diaphragm, and where the diaphragm can move in response to a pressure wave. As such, it can be appreciated that each of the diaphragm and the backplate can have a deformation (e.g., a curvature) caused by a load associated with respective materials that form the diaphragm and backplate.

When compared to conventional technologies, the microelectromechanical microphones of the disclosure provide greater mechanical stability, and can permit increasing the size of a diaphragm without reaching a critical stress and, therefore, avoiding collapse of a portion of the diaphragm.

With reference to the drawings, FIG. 1 illustrates an example of a microelectromechanical microphone die 100 in accordance with one or more embodiments of the disclosure. As illustrated, the microelectromechanical microphone die can include a stationary plate 104 mechanically coupled to a movable plate 110. The movable plate 110 can embody or can constitute a diaphragm of the microelectromechanical microphone, and can include or can be formed from a semiconductor or an electrically conducting material (e.g., a doped semiconductor or a metal). For example, the movable plate 110 can be formed from or can include silicon (amorphous, polycrystalline or crystalline); germanium; a semiconductor compound from group III; a semiconductor compound formed from an element in group III and another element in group V (generally referred to as a III-V semiconductor); a semiconductor compound formed from an element in group II and an element in group VI (generally referred to as a s II-VI semiconductor); or a combination (such as an alloy) of two or more of the foregoing. In addition, the conducting material can include gold, silver, platinum, titanium, other types of noble metals, aluminum, copper, tungsten, chromium, or an alloy of two or more of the foregoing. In certain embodiments, the movable plate 110 can be formed from or can include a composite material containing a dielectric (e.g., silicon dioxide, silicon nitride, or the like) and a semiconductor as disclosed herein. In other embodiments, the movable plate 110 can be formed entirely from a dielectric.

As illustrated, four flexible or otherwise elastic solid members 120*a*-120*d* can mechanically couple the stationary plate 104 to the movable plate 110. Therefore, in one aspect, an outer periphery of the movable plate 110 can move based at least on the stiffness of each of the four flexible members 120*a*-120*d*. It should be appreciated that, in certain embodiments, other number (greater or less than four) of elastic solid members can provide the mechanical coupling. Regardless the number of elastic solid members, such a coupling provides a mechanical boundary condition that is herein referred to as spring-supported boundary condition. In other embodiments, the movable plate 110 can be attached to the stationary plate 104 at certain regions without reliance on elastic solid members. For example, rigid members can pin the movable plate 110 at respective locations on the outer periphery of the movable plate 110. For rigid members can be utilized in one embodiment, whereas more than four or less than four rigid members can be utilized in other embodiments. For another example, the movable plate 110 and the stationary plate 104 can be joined at the entirety of the outer periphery of the movable plate 110 or at certain portions of such periphery. Thus, the movable plate 110 can be referred to as being clamped by the stationary plate 104 and another slab or extended member underlying the stationary plate 104.

The movable plate 110 can include an outer portion that defines a circular cross-section including an outer circular periphery 112 having a radius $R_0$. The movable plate 110 can further define a circular opening 118 having an inner circular periphery 116 of radius $R_i$. Accordingly, the movable plate 110 defines an annular region 114. In one example, a ratio between $R_0$ and $R_i$ can range from about 2 to about 15. In one example, the ratio $\rho=R_0/R_i$ (where ρ is a real number) can be about 3. In another example, ρ can be about 7. In yet other examples, ρ can be greater than about 3 and less than about 7. In still other examples, ρ can be greater than about 2 and less than about 10. In a further example, ρ can be one of about 2, about 3, about 4, about 6, about 7, about 8, about 9, or about 10.

A portion of the movable plate 110 that includes the inner circular periphery 116 can be mechanically coupled (e.g., rigidly attached) to a dielectric member 130 that extends from a surface of such a portion to a surface of a stationary plate 150, which also can be referred to as a backplate. As illustrated, the dielectric member 130 can define a curved surface having cylindrical symmetry, e.g., a circular section. In certain embodiments, the dielectric member 130 can define a surface that is centrosymmetric—e.g., the surface can define a square section, a pentagonal section, a hexagonal section, a heptagonal section, an octagonal section, or any other polygonal section. The dielectric member 130 also can define a second curved surface (not depicted) having cylindrical symmetry or other type of symmetry. Therefore, the dielectric member 130 can embody a hollow dielectric member (e.g., a hollow shell or another type of hollow structure) having a defined thickness. It can be appreciated that a portion of the dielectric member 130 forms an interface with a portion of the movable plate 110. Accordingly, unless a material that forms the dielectric member 130 is lattice-matched with and/or has essentially the same coefficient of thermal expansion as a material that forms the portion of the movable plate 110, such an interface can introduce strain between the dielectric member 130 and the movable plate 110. Such strain can result in an accumulation of elastic energy, which can be controlled by controlling the thickness of the dielectric member 130. It also can be appreciated that the dielectric member 130 forms an interface with a portion of the stationary plate 150. Therefore, strain also can be introduced between the dielectric member 130 and the stationary plate 150. In one scenario, such a strain can be originate from mismatch in lattice parameters and/or mismatch in coefficient(s) of thermal expansion between the material that forms the dielectric member 130 and a material that forms the stationary plate 150. Elastic energy resulting from such strain can be controlled by controlling the thickness of the dielectric member 130. It should be appreciated that while the dielectric member 130 is employed to describe embodiments of this disclosure, the disclosure is not limited in that respect. Specifically, in certain embodiments, a rigid member including a dielectric material and a non-dielectric material can be utilized, providing the same functionality as that of the dielectric member 130.

It should be appreciated that, for a specific radius $R_i$, increasing indefinitely the outer radius $R_0$ can yield a buckling instability. In one aspect, the relative deformation between the stationary plate 150 and the movable plate 110 can increase with the outer radius R0. As such, including the dielectric member 130 or other type of rigid member with the same functionality can permit the stationary plate 150 and the movable plate 110 to move jointly. In another aspect, based at least on (i) respective thicknesses and materials that form or otherwise constitute the movable plate 110, the stationary plate 150, and the dielectric member 130, and (ii) outer boundary conditions determined by the specific mechanical coupling between the movable plate 110 and the stationary plate 104 (see, e.g., FIG. 1), the structure formed by the stationary plate 150 and the movable plate 110 can reach a critical load—due to mismatch of materials, for example—at which the structure becomes unstable. Similar aspects are present when the size of the stationary plate 150 is increased. Therefore, the ratio ρ cannot be increased indefinitely. In order to avoid such an instability, the ratio between the outer radius R0 and the inner radius Ri can be bound or otherwise can be reduced below a certain value depending on stresses present in the materials that constitute the microelectromechanical microphone, including the type of materials and/or thicknesses associated with the movable plate 110, the stationary plate 150, and a dielectric material that can form or be included in the dielectric member 130.

The dielectric member 130 is rigid and, thus, can render stationary at least a portion of the movable plate 110 including the inner periphery 116. In the illustrated embodiment, the dielectric member 130 can be hollow, and can be formed from or can include amorphous silicon, a semiconductor oxide (e.g., silicon dioxide), a nitride, or other type of insulator. In other embodiments, the dielectric member 130 can be formed from or can include a semiconductor, such as a silicon, germanium, an alloy of silicon and germanium, a III-V semiconductor compound, a II-VI semiconductor compound, or the like. In certain embodiments, the dielectric member 130 is embodied in or includes a hollow shell having a thickness based at least on a material that forms the movable plate 110 and a material that forms the dielectric member 130.

The stationary plate 150 defines openings (not shown in FIG. 1) configured to permit passage of air that propagates an acoustic wave, which can include an audible acoustic wave and/or an ultrasonic acoustic signal. It should be appreciated that, more generally, such openings can permit passage of a fluid that propagates a pressure wave. In certain embodiments, the stationary plate 150 and the movable plate 110 can include or can be formed from the same electrically conducting material, e.g., a doped semiconductor or a metal. More generally, the stationary plate 150 can be formed from or can include the same or similar material(s) as the movable plate 110. As such, for example, the stationary plate 150 can be formed from or can include amorphous silicon, polycrystalline silicon, crystalline silicon, germanium, an alloy of silicon and germanium, a III-V semiconductor, a II-VI semiconductor, a dielectric (silicon dioxide, silicon nitride, etc.), or a combination (such as an alloy or a composite) of two or more of the foregoing. The stationary slab 104 and the stationary plate 150 are mechanically coupled (e.g., attached) by means of a dielectric slab 140. In certain embodiments, the dielectric member 130 and the dielectric slab 140 can include or can be formed from the same electrically insulating material, e.g., amorphous silicon, silicon dioxide, silicon nitride, or the like.

The microelectromechanical microphone die 100 also includes a dielectric slab 160 that mechanically couples the stationary plate 150 a substrate 170. While not shown in the perspective view in FIG. 1, the substrate 170 can define an opening configured to receive a pressure wave, e.g., an acoustic wave. In certain embodiments, the substrate 170 can include or can be formed from a semiconductor (intrinsic or doped) or a dielectric. For example, the substrate 170 can include or can be formed from or can include amorphous silicon, polycrystalline silicon, crystalline silicon, germanium, or an alloy of silicon and germanium, a semiconductor from group III, a semiconductor from group V, a semiconductor from group II, a semiconductor from group VI, or a combination of two or more of the foregoing.

Figure 2:
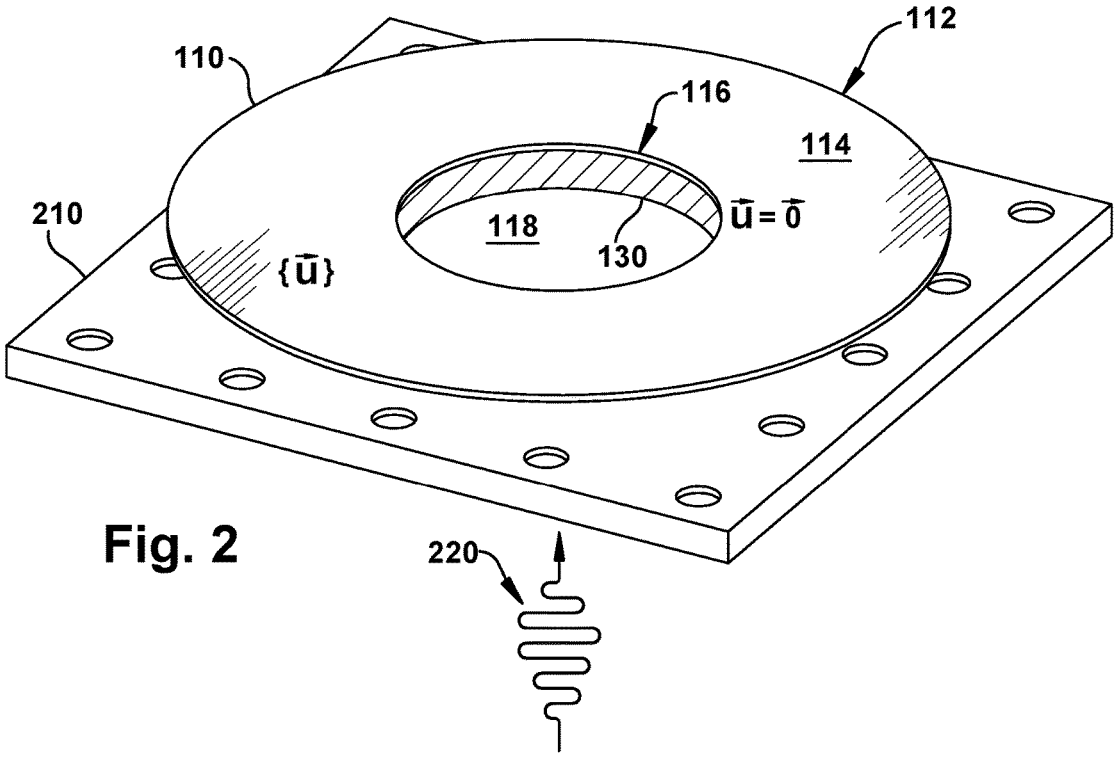
FIG. 2 illustrates a perspective view of an example of a diaphragm and a backplate in a microelectromechanical microphone in accordance with one or more embodiments of the disclosure.
Figure 3:
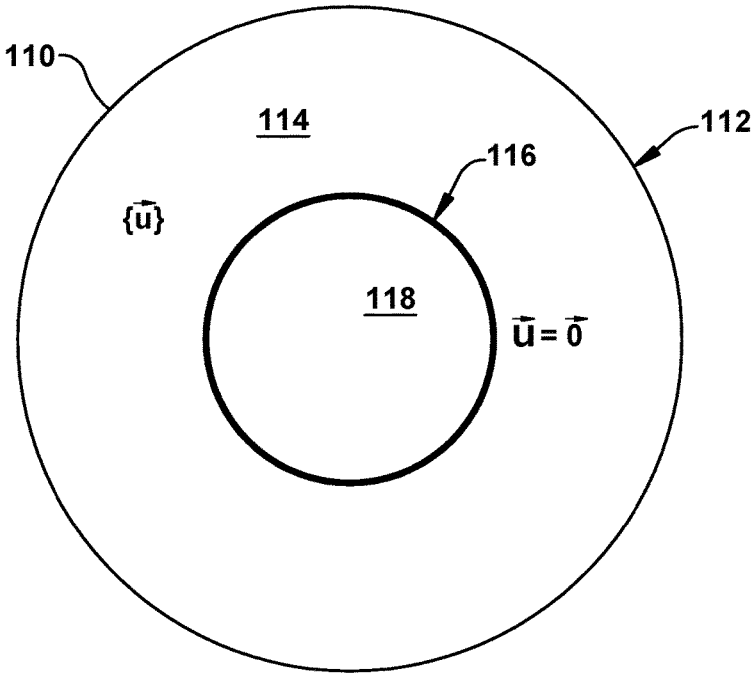
FIG. 3 illustrates a top view of an example of a diaphragm in a microelectromechanical microphone in accordance with one or more embodiments of the disclosure.

FIG. 2 illustrates a perspective view of the movable plate 110 and a portion 210 of the stationary slab 150 in accordance with one or more embodiments of the disclosure. As described herein, the portion 210 defines openings. In certain embodiments, the openings can be arranged in a regular lattice or a non-regular lattice. Each of the openings can be configured to permit passage of fluid that propagates a pressure wave 220, which can include or can be embodied in an acoustic wave that can include an audible acoustic wave or an ultrasonic acoustic wave. Propagation of the pressure wave 220 can cause the movable plate 110 to move. The movement of the movable plate 110 can be represented or otherwise indicated by a group of displacement vectors, each having a magnitude and orientation that depends on position within the movable plate 110. The displacement vectors can cause a deformation of the movable plate 110, changing, for example, a curvature of the movable plate 110. Without intending to be bound by theory and/or modeling, the displacements vectors within the annular region 114 can be finite and or null depending on the pressure wave 220. Yet, the displacement vectors at a portion of the movable plate 110 proximate to, and including, the inner periphery 116 are null, depicted as u=0, because the dielectric member 130 renders such a portion stationary. As an illustration, FIG. 3 presents a top view of the movable plate 110 where the inner periphery 116 is stationary (depicted with a thick line) independently from the characteristics of the pressure wave 220, and the annular region 114 can have displacement vectors {u} based at least on the characteristics. It should be appreciated that the specific displacement vectors at the outer periphery 112 can be based on a boundary condition imparted by type of mechanical coupling (e.g., flexible coupling provided by means of elastic members) between the diaphragm 110 and an adjacent stationary slab.

Figure 4A:
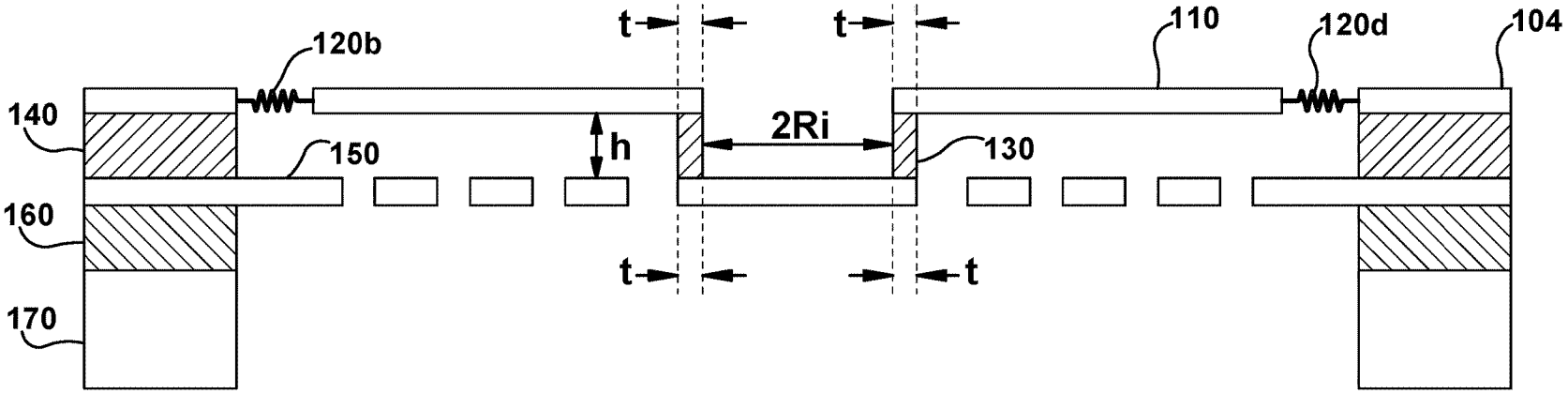
FIG. 4A illustrates a cross-sectional view of an example of a microelectromechanical microphone die in accordance with one or more embodiments of the disclosure.
Figure 4B:
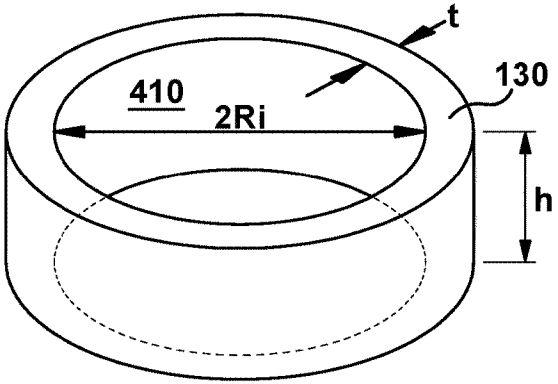
FIG. 4B illustrates a perspective view of an example of a dielectric member in a microelectromechanical microphone in accordance with one or more embodiments of the disclosure.

As described herein, the dielectric member 130 that renders stationary a portion of the movable plate 110 extends from a surface of the stationary slab 150 to a surface of the movable plate 110. FIG. 4A illustrates such a mechanical coupling in a cross-sectional view of the microelectromechanical microphone die 100 in accordance with one or more embodiments described herein. The movable plate 110 defines an opening of circular section and diameter $2R_i$, and can be disposed at a distance h (a real number) overlying the stationary slab 150. As illustrated, the dielectric member 130 can be arranged (e.g., fabricated) to extend from a region proximate to, and including, an edge of a portion of the stationary slab 105 underlying such an opening. Further, the dielectric member 130 can extend to a region proximate to, and including, the inner periphery 116. It should be appreciated that the disclosure is not limited with respect to such an arrangement, and other arrangements that mechanically couple certain portion of the stationary plate 150 to certain portion of the movable plate 110 also are contemplated (see, e.g., FIG. 4E). In such an example arrangement, the dielectric member 130 can define, for example, a hollow dielectric shell having thickness t and height h, where t and h are both real numbers. As illustrated in FIG. 4B, such a shell can have cylindrical symmetry, defining an opening of circular cross-section of radius $R_i$. In certain embodiments, the ratio between $2R_i$ and t can range from about 3 to about 300. Stated equivalently, the diameter of the opening 410 can be, in such embodiments, about one to about two orders of magnitude greater than the thickness of dielectric member 130.

Figure 4C:
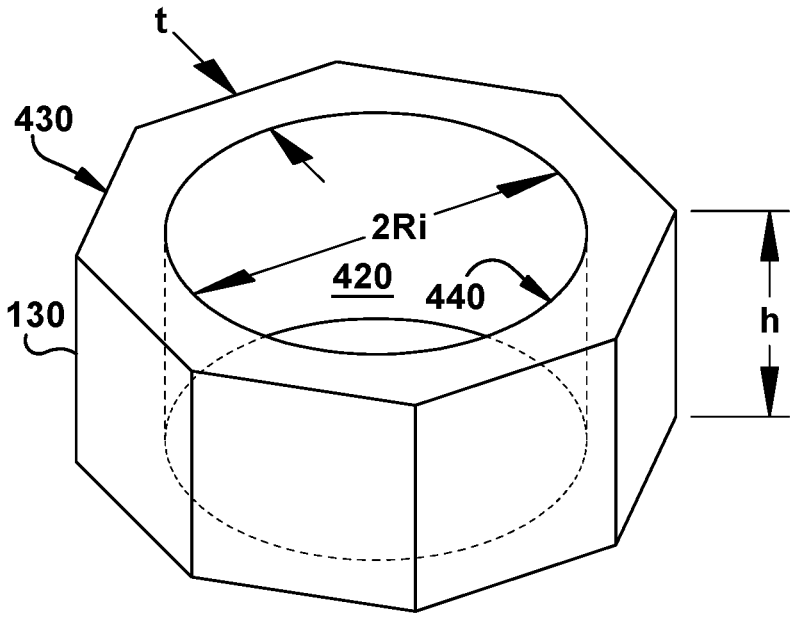
FIG. 4C illustrates a perspective view of another example of a dielectric member in a microelectromechanical microphone in accordance with one or more embodiments of the disclosure.

It should be appreciated that, in certain embodiments, the dielectric member 130 can define a hollow dielectric shell defining a centrosymmetric cross-section. In one example, a thickness of the hollow dielectric shell can be about one order of magnitude less than a width of the centrosymmetric cross-section. Each of the thickness and the width of the centrosymmetric cross-section can be determined based at least on a material that forms the movable plate 110 and a material that forms the dielectric member 130. As an example, FIG. 4C presents a perspective view of an example of such a hollow dielectric shell. The hollow dielectric shell defines an opening 420 having an inner circular periphery 440 of radius $R_i$. The hollow dielectric shell further defines and an outer octagonal periphery 430 that is centrosymmetric. In certain embodiments, the ratio between $2R_i$ and t can range from about 3 to about 300. Stated equivalently, the diameter of the opening 410 can be, in such embodiments, about one to about two orders of magnitude greater than the thickness of dielectric member 130.

Figure 4D:
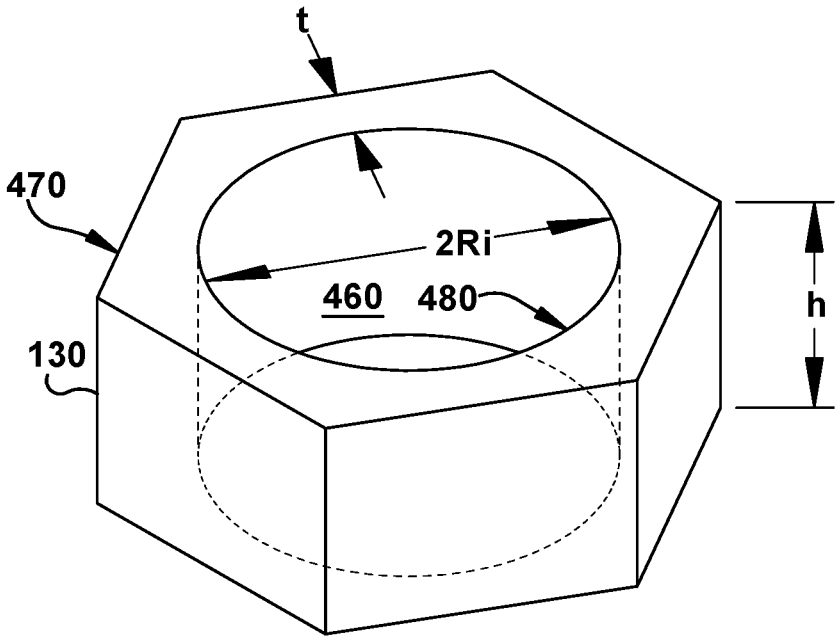
FIG. 4D illustrates a perspective view of yet another example of a dielectric member in a microelectromechanical microphone in accordance with one or more embodiments of the disclosure.

FIG. 4D illustrates a perspective view of yet another example of a dielectric member in a microelectromechanical microphone in accordance with one or more embodiments of the disclosure. In certain embodiments, the ratio between $2R_i$ and t can range from about 3 to about 300. Stated equivalently, the diameter of the opening 410 can be, in such embodiments, about one to about two orders of magnitude greater than the thickness of dielectric member 130.

Figure 4E:
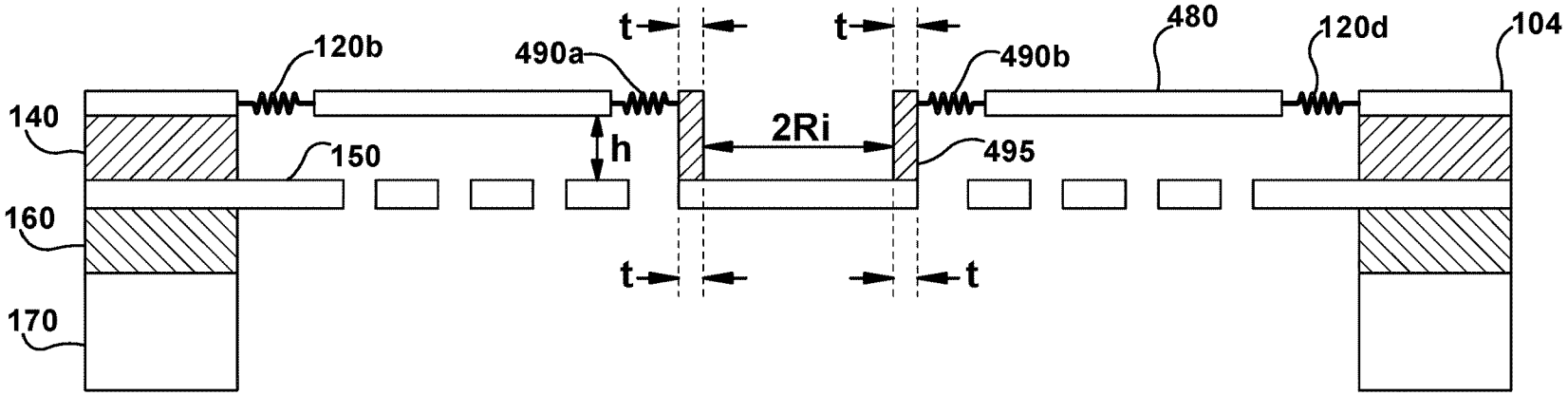
FIG. 4E illustrates a cross-sectional view of an example of a microelectromechanical microphone die in accordance with one or more embodiments of the disclosure.

In certain embodiments, instead of the dielectric member 130, other types of rigid members can be utilized to couple the movable plate 110 to the stationary slab 150. Such rigid members can permit a different type of boundary condition for the inner portion of a movable plate in accordance with this disclosure. FIG. 4E presents a cross-sectional view of an example of the microelectromechanical microphone die 100 having a spring-supported boundary condition at an inner portion of a movable plate 480. As illustrated, an outer portion of the movable plate 480 is mechanically coupled to the stationary plate 104 via at least flexible members 120*b* and 120*d*. In addition, an inner portion of the movable plate 180 is mechanically coupled to a rigid member 495 via at least an elastic member 490*a* and an elastic member 490*b*. In the illustrated embodiment, the rigid member 495 is embodied in a hollow shell formed from a dielectric material (e.g. silicon dioxide, silicon nitride, or the like). The hollow dielectric shell has a thickness t (a real number) and an internal radius $R_i$ (a real number). In other embodiments, the rigid member 495 can include or can be formed from a dielectric material and a non-dielectric material. Similar to other embodiments of this disclosure, the movable plate 480 defines an opening of circular section and diameter $2R_i$, and can be disposed at a distance h (a real number) overlying the stationary slab 150. As illustrated, the rigid member 495 can be arranged (e.g., fabricated) to extend from a region proximate to, and including, an edge of a portion of the stationary slab 105 underlying the opening. In addition, the rigid member 495 can extend to a region in the vicinity of an inner periphery of the movable plate 480, and can be flexibly coupled to respective portions of the inner periphery via the elastic member 490*a* and the elastic member 490*b*.

Figure 5A:
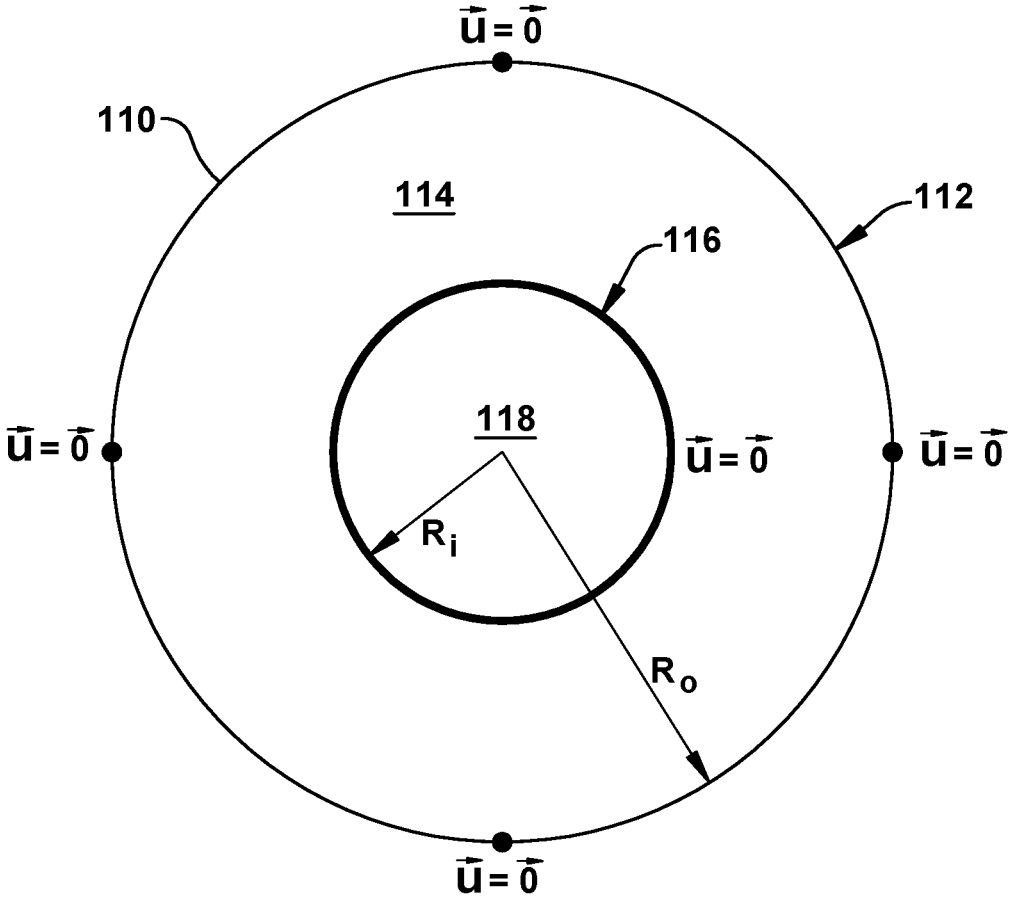
FIGS. 5A-5B illustrates top views of examples of diaphragms having respective boundary conditions in accordance with one or more embodiments of the disclosure.

FIG. 5A presents a top view of movable plate 110 under example boundary conditions at the outer periphery 112 and the inner periphery 116 in accordance with one or more embodiments of the disclosure. The inner periphery 116 is stationary, e.g., displacement vectors are null, and the outer periphery 112 is pinned at four locations, represented with solid dots. Displacement vectors at such locations are null, e.g., u=0. While four locations are depicted for the sake of illustration, it should be appreciated that this disclosure is not limited in this respect and a number of locations less than four or greater than four also is contemplated. Such a boundary condition for the outer periphery 112 can be utilized or otherwise leverage in embodiments in which the $R_o$ is much greater than $R_i$ (e.g., $R_o$ is about three to about five times greater than $R_i$). In such embodiments, buckling instability or collapse of outer portions of the movable plate 110 may be more likely to occur.

Figure 5B:
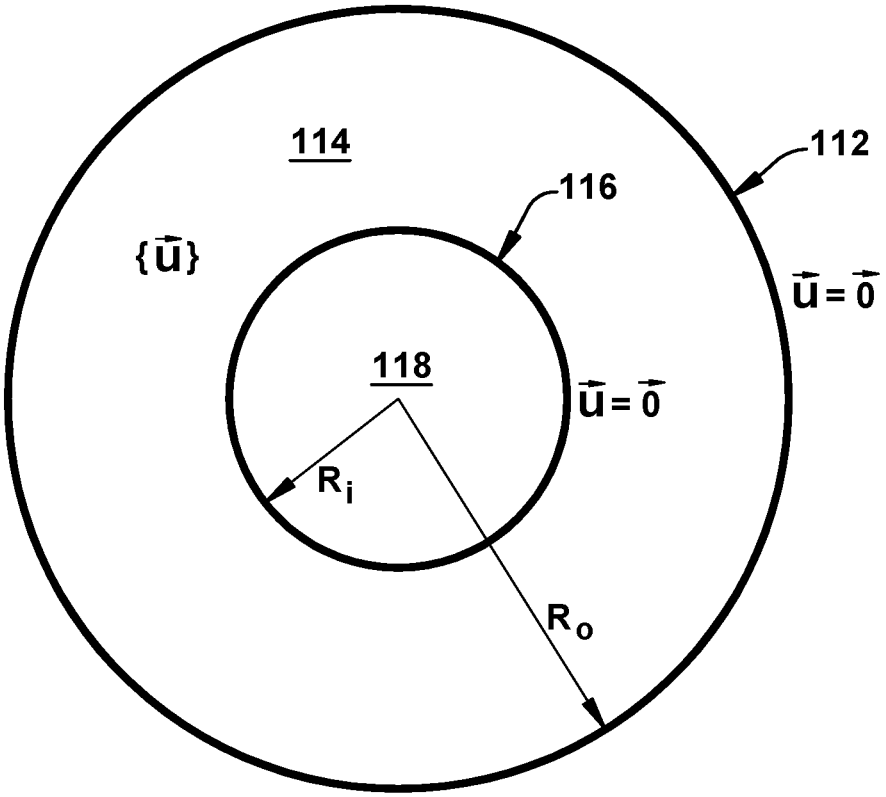

FIG. 5B presents a top view of movable plate 110 under other example boundary conditions at the outer periphery 112 and the inner periphery 116 in accordance with one or more embodiments of the disclosure. The inner periphery 116 and the outer periphery 112 each is stationary, e.g., displacement vectors are null, whereas displacement vectors within the annular region 114 excluding both of such peripheries can be determined at least by a pressure wave (e.g., pressure wave 220) impinging on the microelectromechanical microphone die 100, for example. Such a boundary condition for the outer periphery 112 can be utilized or otherwise leveraged, for example, in embodiments in which the $R_o$ is much greater than $R_i$ (e.g., $R_o$ is about five to about ten times greater than $R_i$). In such embodiments, buckling instability or collapse of outer portions of the movable plate 110 may be more likely to occur.

Figure 6:
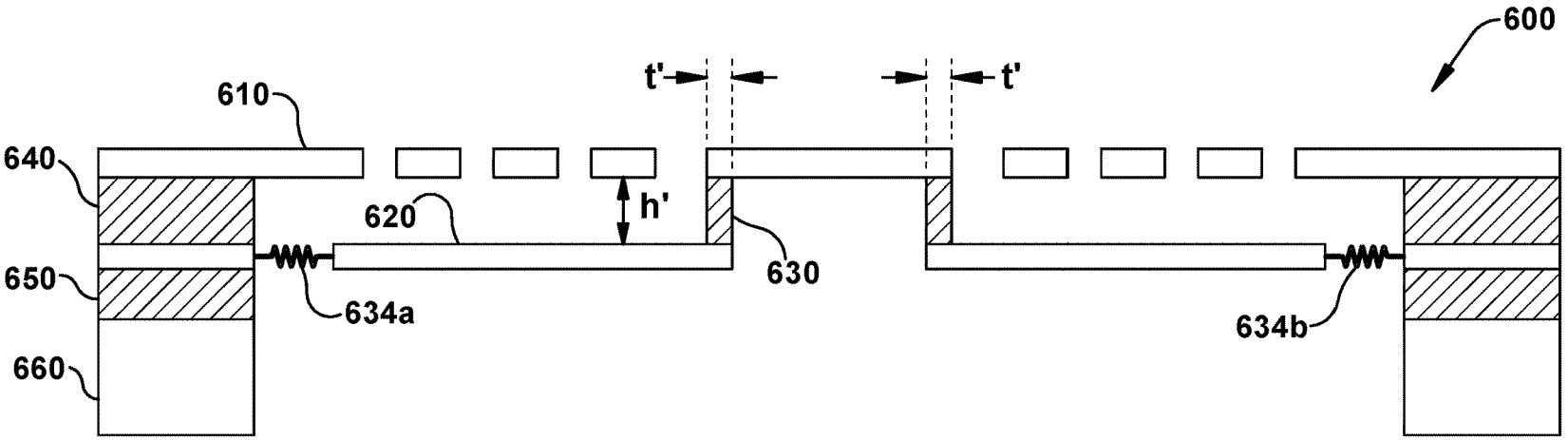
FIG. 6 illustrates a cross-sectional view of an example of a microelectromechanical microphone die in accordance with one or more embodiments of the disclosure.

FIG. 6 illustrates a cross-sectional view of an example of a microelectromechanical microphone die 600 in accordance with one or more embodiments of the disclosure. A stationary slab 610 overlies a movable plate 620, and is separated by a distance h' from a top surface of the movable plate 620. The movable plate 620 can embody a diaphragm of the microelectromechanical microphone formed in the die 600. As illustrated, the movable plate 620 is flexibly coupled to stationary portions via respective flexible members 634*a* and 634*b*, each represented as a spring. The flexible members 634*a* and 634*b* permit, at least in part, the movable plate 620 to move in response to an acoustic wave impinging onto the movable plate 620. A dielectric slab 640 mechanically couples the stationary plate 610 (which also may be referred to as backplate 610) and the movable plate 620. A dielectric member 630 extends from a surface of the stationary plate 610 to a surface of the movable plate 620. In certain embodiments, the dielectric member 630 can define an inner surface and an outer surface mutually separated by a layer of thickness t'. The movable plate 620 overlies a substrate 660 and is mechanically coupled thereto by means of a dielectric slab 650. Similarly to the substrate 170, the substrate 660 defines an opening configured to receive an acoustic wave that can include an audible wave and/or an ultrasonic wave.

Figure 7:
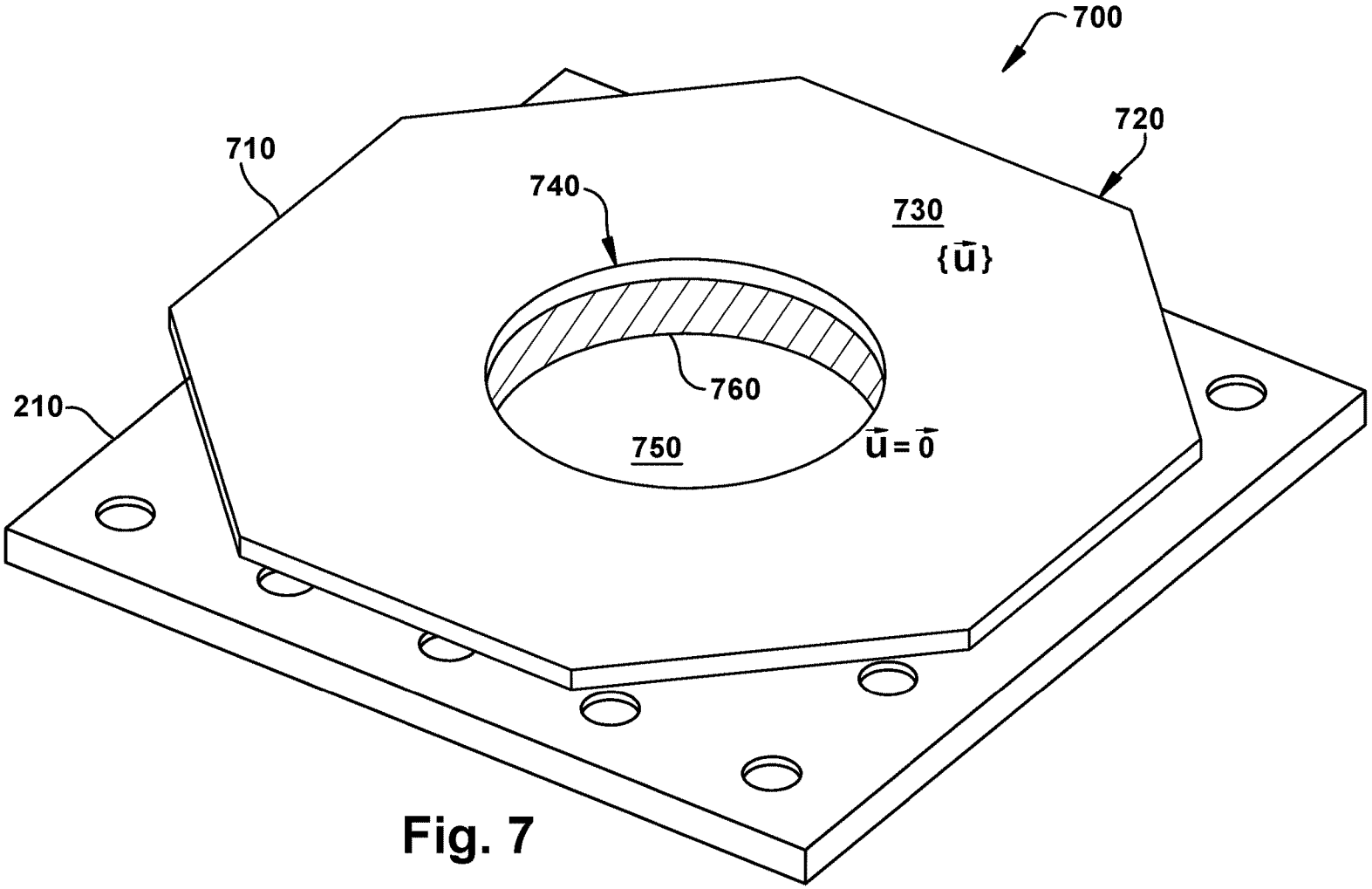
FIG. 7 illustrates a perspective view and a top view of an example of a diaphragm in a microelectromechanical microphone in accordance with one or more embodiments of the disclosure.

FIG. 7 illustrates a perspective view 700 of an example of a diaphragm 710 in a microelectromechanical microphone in accordance with one or more embodiments of the disclosure. In certain implementations, the microelectromechanical microphone die 100 can include the diaphragm 710 instead of the movable plate 110. As illustrated, the diaphragm 710 defines an octagonal outer periphery 720 and a circular inner periphery 740 defining an opening 750 of circular section. The diaphragm 710 includes a region 730 defined by the circular inner periphery 740 to the outer octagonal periphery 710. Similar to other diaphragms of the disclosure, a dielectric member 760 extends from a surface of a portion of the diaphragm 710 to a surface of the stationary plate 210 that embodies or includes a backplate. The dielectric member 760 is rigid and forms an interface with the portion of the diaphragm 710, causing at least the interface and the circular inner periphery 740 to be stationary. In contrast, the region 730 can elastically deform in response to a pressure wave impinging thereon. Accordingly, in response to the pressure wave, displacement vectors {u} represent the deformation of the region 730, whereas displacement vectors of the diaphragm 710 at least at the circular inner periphery 740 can be null (represented as u=0 in FIG. 7). The diaphragm 710 is embodied in or constitutes a movable plate.

Figure 8:
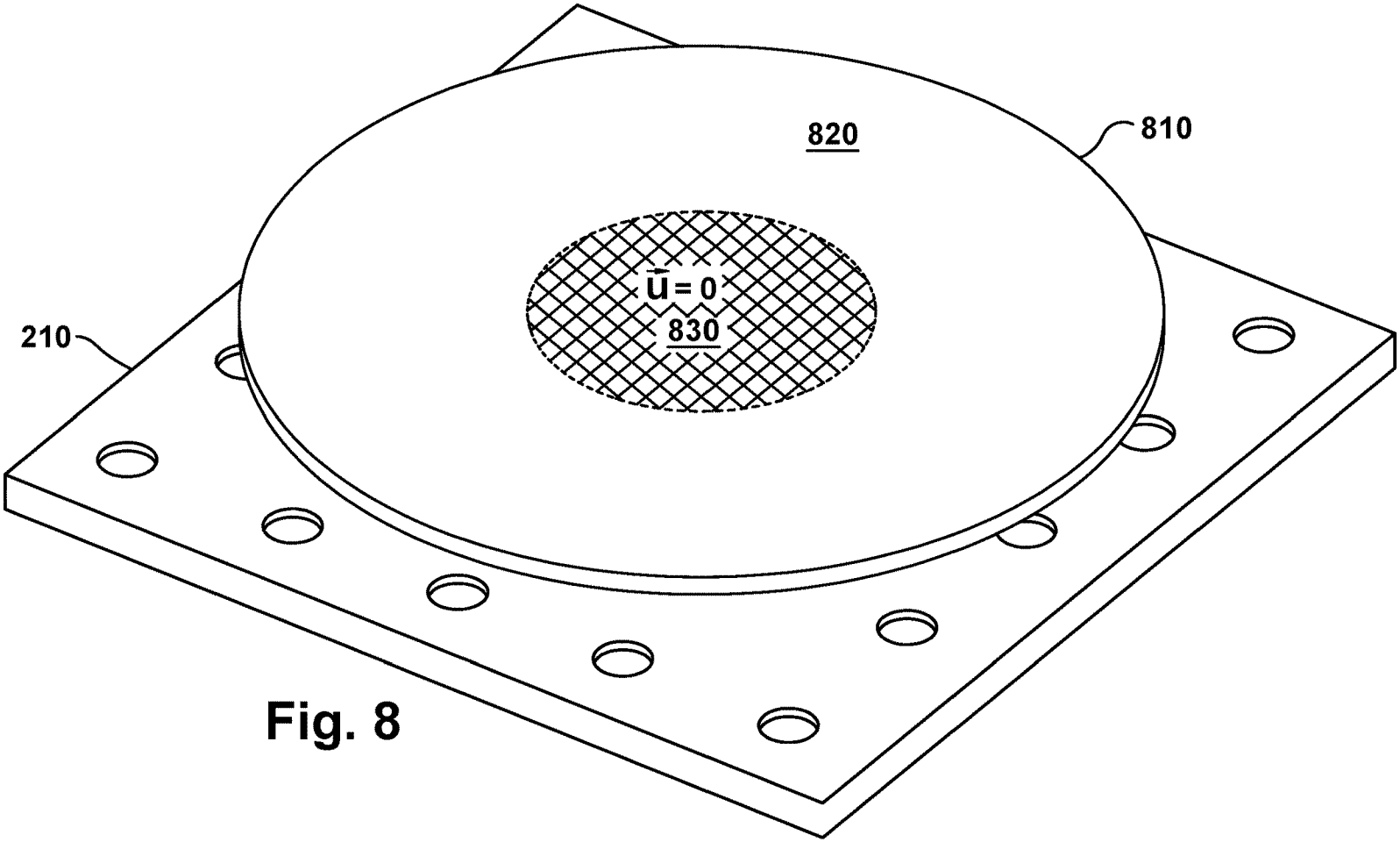
FIG. 8 illustrates a perspective view and a top view of another example of a diaphragm in a microelectromechanical microphone in accordance with one or more embodiments of the disclosure.

In certain embodiments, a microelectromechanical microphone in accordance with this disclosure can include a diaphragm having an inner stationary region without defining an opening. Specifically, in one example, FIG. 8 illustrates a diaphragm 810 that has a portion 830 that is stationary, and thus, displacement vectors of such a portion can be null (represented with u=0) in response to a pressure wave. The diaphragm 810 has a second portion 820 (depicted as cross-hatched) that can deform elastically in response to the pressure wave. The diaphragm 810 is embodied in or constitutes a movable plate.

Figure 9:
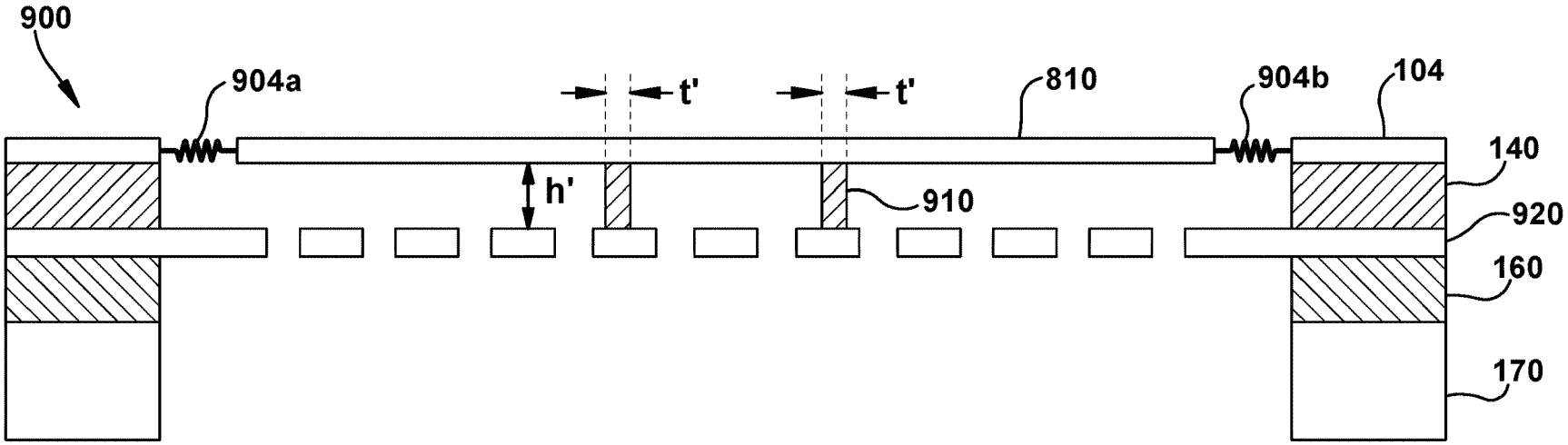
FIG. 9 illustrates a cross-sectional view of an example of a microelectromechanical microphone die in accordance with one or more embodiments of the disclosure.

Similar to stationary inner peripheries described herein, the stationary portion 830 of the diaphragm 810 can be formed by mechanically coupling the diaphragm 810 to a stationary plate 210 by means of a dielectric member. As an illustration, FIG. 9 presents an example of a hollow dielectric member 910 that can attach the diaphragm 810 to a stationary plate 920. As illustrated, the diaphragm 810 is flexibly coupled to stationary portions via respective flexible members 904*a* and 904*b*, each represented as a spring. The flexible members 940*a* and 940*b* permit, at least in part, the movable plate 810 to move in response to an acoustic wave impinging onto the diaphragm 810. The hollow dielectric member 910 extends from a surface of the diaphragm 810 to a surface of the stationary plate 920. The hollow dielectric member 910 can be rigid and, in one example, can define an opening of circular section that yields the stationary portion 830 shown in FIG. 8. As described herein, the hollow dielectric member 910 can include or can be formed from amorphous silicon, a semiconductor oxide (e.g., silicon dioxide), or a nitride (e.g., silicon nitride). More specifically, in one example shown in FIG. 10, the hollow dielectric member 910 can be embodied in a hollow dielectric shell 1010 that defines a circular opening 1015 and has a thickness t'. The length h' of the hollow dielectric shell 1010 can be determined by the spacing between the diaphragm 810 and the stationary plate 920. Similar to other hollow dielectric shells of this disclosure, in certain embodiments, the ratio between the diameter $D=2R_i$ of the circular opening and t' can range from about 3 to about 300. For instance, t' can be about 0.5 μm and D can be about 50 Stated equivalently, the diameter D of the opening 1015 can be, in such embodiments, about one to about two orders of magnitude greater than the thickness of dielectric member 130. In certain embodiments, the ratio between diameter D and thickness of the dielectric member 130 can be in the range from about 10 to 25. It should be appreciated that such thin hollow dielectric shell can limit the stress(es) imparted onto the movable plate 110 and/or the stationary plate 150, thus avoiding a critical load or stress that can cause buckling instability.

Figure 10:
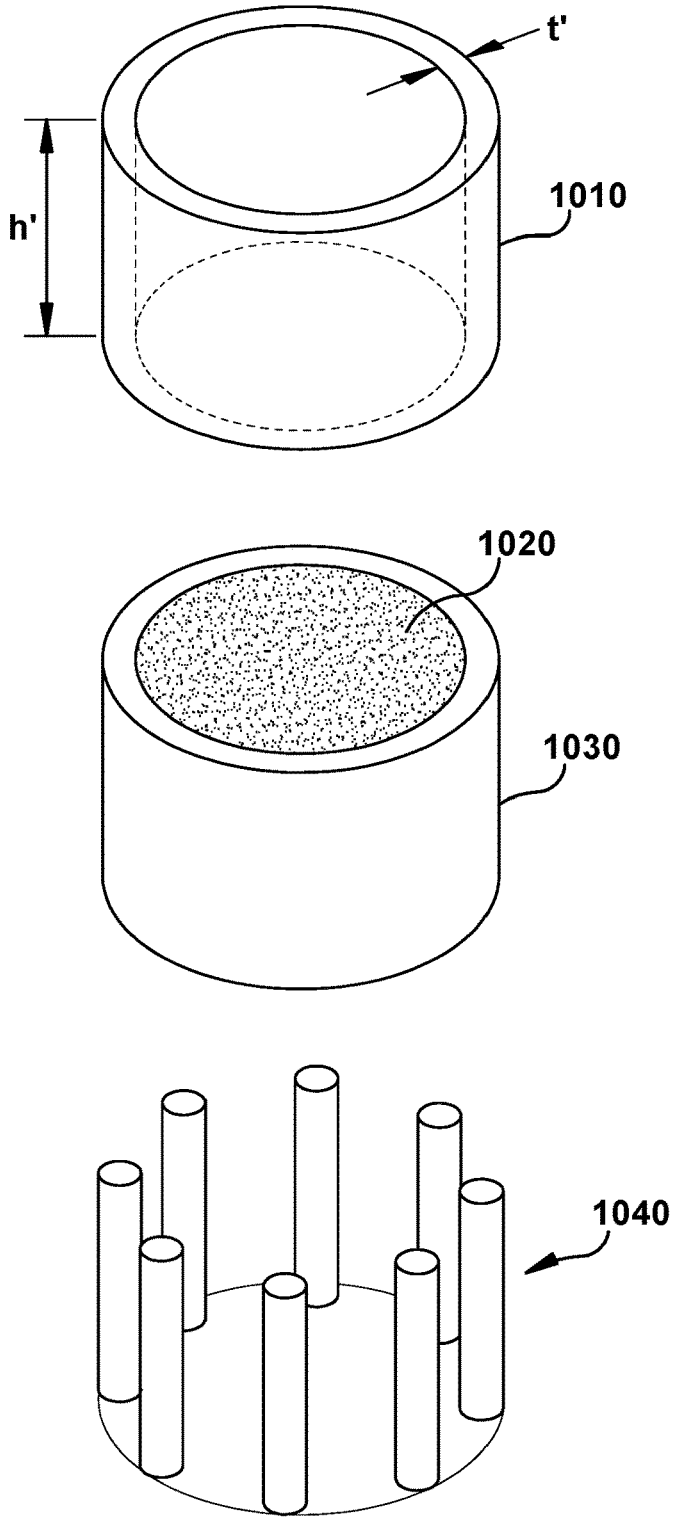
FIG. 10 illustrates perspective views of respective examples of a dielectric member in a microelectromechanical microphone in accordance with one or more embodiments of the disclosure.
Figure 11:
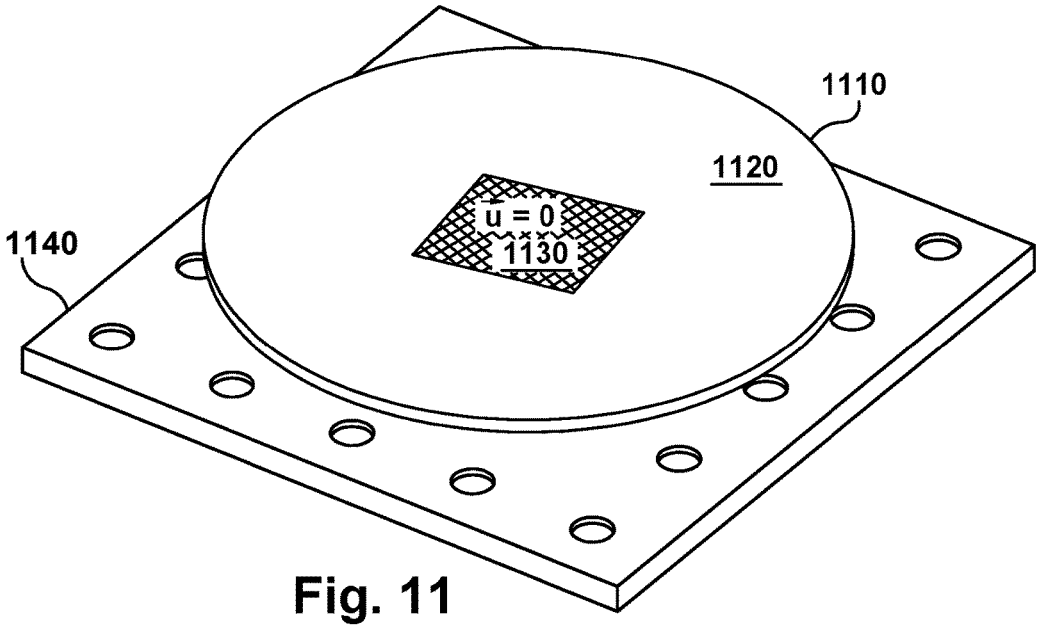
FIGS. 11-14 illustrate perspective views other examples of a diaphragm in a microelectromechanical microphone in accordance with one or more embodiments of the disclosure.
Figure 12:
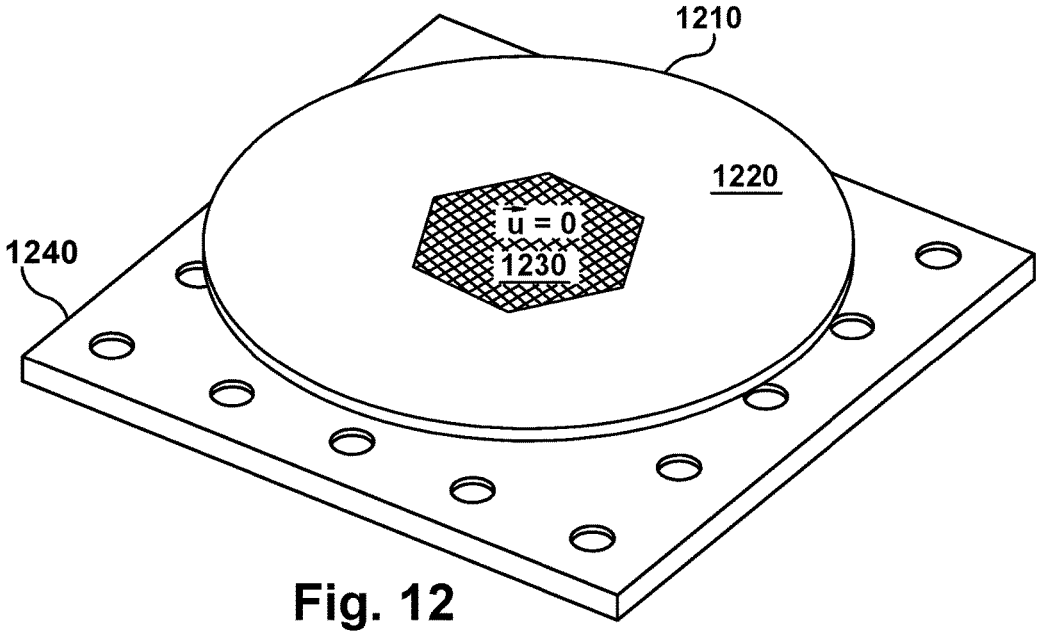
Figure 13:
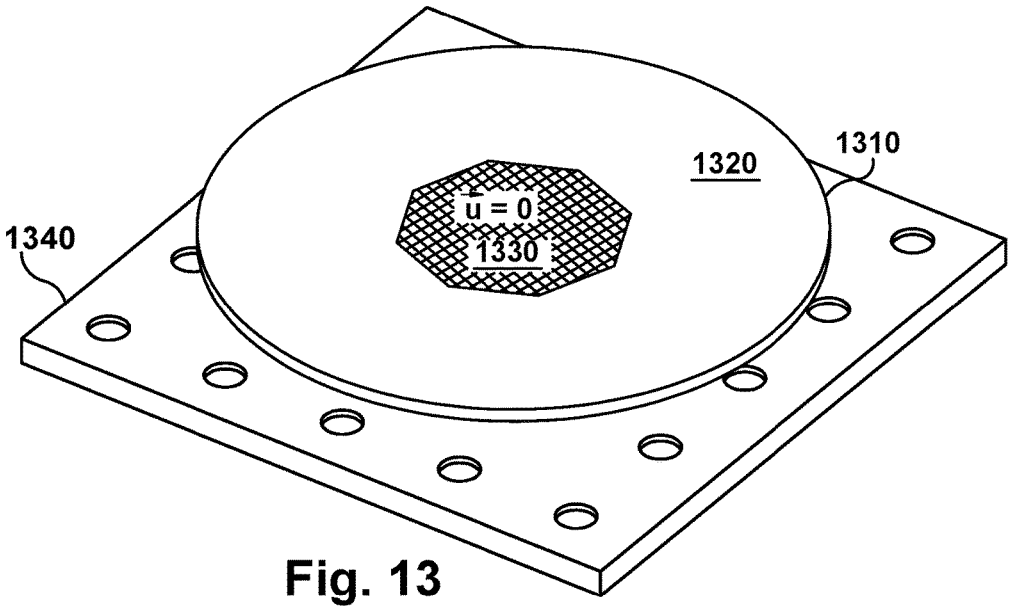
Figure 14:
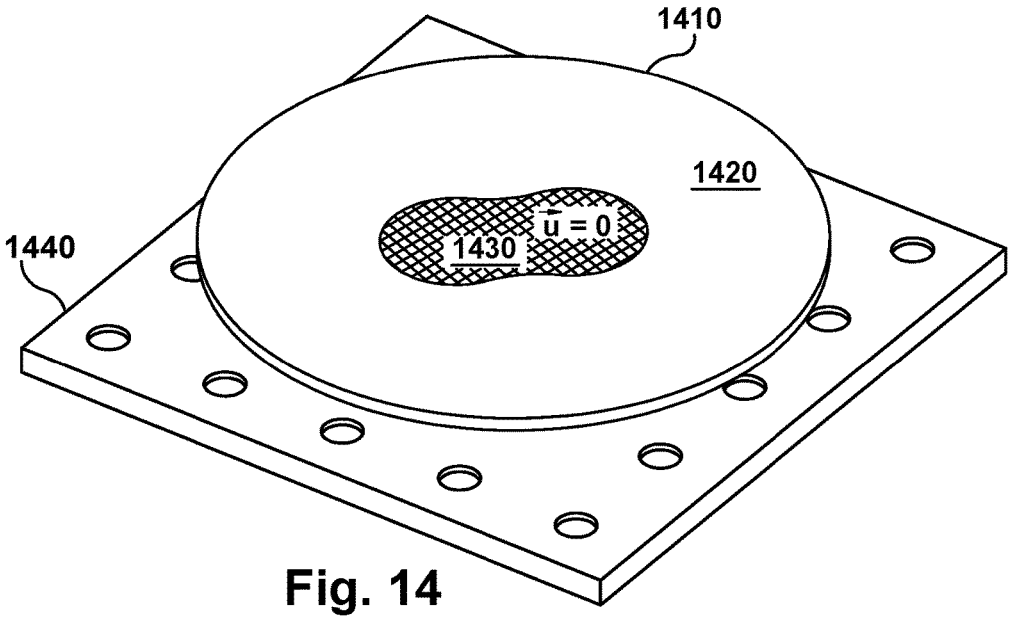

A dielectric member that can mechanically couple the diaphragm 810 to a stationary plate 210 in a microelectromechanical microphone may be embodied in a structure other than the hollow dielectric shell 1010. For instance, as shown in FIG. 10, the dielectric member can be embodied in a core-shell structure having a hollow dielectric shell 1020 and a core 1030 of an electrically insulating material. Adding the core 1030 can provide greater stability to the diaphragm 810, which can permit increasing its size, thus increasing the sensitivity of the microelectromechanical microphone. In addition or in the alternative, the material of the core 1030 can be substantially lattice-matched to material of the diaphragm 810, and/or can have a coefficient of thermal expansion that is matched to the material of the diaphragm 810. In either instance, such a matching can mitigate strain, with the ensuing increase in durability of the microelectromechanical microphone. While a single core is shown, it should be appreciated that the disclosure is not limited in this respect and more than one core structures can be contemplated.

In addition or in other embodiments, multiple dielectric members can be leveraged to mechanically couple the diaphragm 810 to a stationary plate in a microelectromechanical microphone. Specific arrangement of the dielectric members can render static a portion of the diaphragm 810. In one example, as shown in FIG. 10, a group 1030 of dielectric members can be disposed in a circular arrangement onto a surface of the stationary plate, and can extend to the diaphragm 810 forming respective interfaces therewith. Relying on the group 1030 can permit reducing the elastic energy associated with the formation of interfaces between a dielectric member and the diaphragm 810, thereby permitting to stability the diaphragm 810 while containing the amount of strain present in the microelectromechanical microphone. Any number greater or less than eight dielectric members can be utilized to attach the diaphragm 810 to the stationary plate.

The stationary inner portion of a diaphragm in a microelectromechanical microphone of this disclosure can span other regions beside the circular portion 830. FIGS. 11-14 illustrate examples of diaphragms having respective stationary inner portions of different cross sections. Specifically, diaphragm 1110 shown in FIG. 11 includes a portion 1120 that can deform elastically in response to a pressure wave impinging onto a surface of the diaphragm 1110. In addition, the diaphragm 1110 includes a stationary inner portion 1130 defining a square section. In response to the pressure wave, displacement vectors {u} of the stationary inner portion 1130 are null (represented as {u}=0). In addition, diaphragm 1210 shown in FIG. 12 includes a portion 1220 that can deform elastically in response to a pressure wave impinging onto a surface of the diaphragm 1210. In addition, the diaphragm 1210 includes a stationary inner portion 1230 defining a hexagonal section. In response to the pressure wave, displacement vectors {u} of the stationary inner portion 1230 are null (represented as {u}=0). Further, diaphragm 1310 shown in FIG. 13 includes a portion 1320 that can deform elastically in response to a pressure wave impinging onto a surface of the diaphragm 1310. In addition, the diaphragm 1310 includes a stationary inner portion 1330 defining an octagonal section. In response to the pressure wave, displacement vectors {u} of the stationary inner portion 1130 are null (represented as {u}=0). Still further, diaphragm 1410 shown in FIG. 14 includes a portion 1420 that can deform elastically in response to a pressure wave impinging onto a surface of the diaphragm 1410. In addition, the diaphragm 1410 includes a stationary inner portion 1430 defining an oblong section. In response to the pressure wave, displacement vectors {u} of the stationary inner portion 1130 are null (represented as {u}=0).

Figure 15:
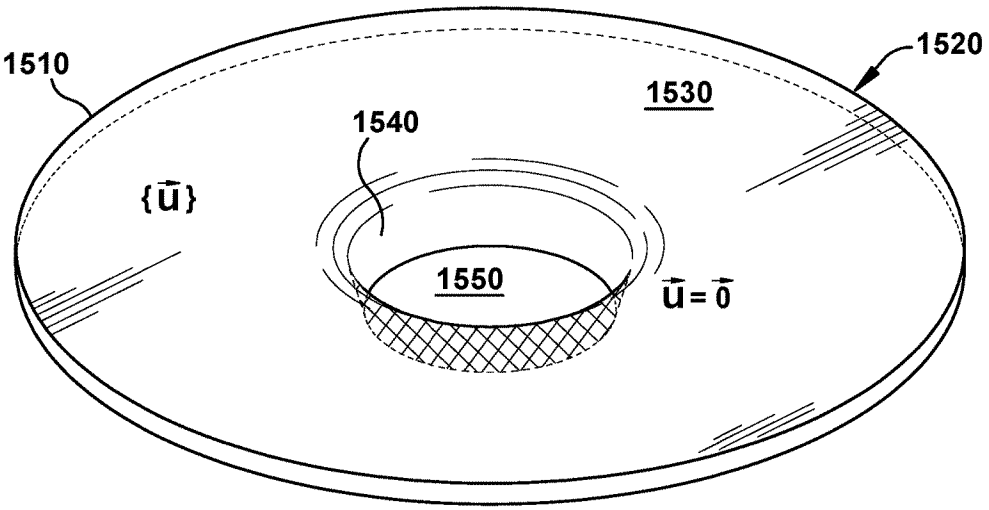
FIG. 15 illustrates a perspective view of another example of a diaphragm in a microelectromechanical microphone in accordance with one or more embodiments of the disclosure.

In certain embodiments, a microelectromechanical microphone in accordance with the present disclosure can include a diaphragm that is non-planar and has a stationary inner portion. FIG. 15 illustrates an example of a non-planar diaphragm 1510 in accordance with one or more embodiments of the disclosure. The non-planar diaphragm 1510 has a portion 1530 that defines a cavity 1540 having a circular cross-section. The cavity 1540 can be shaped, for example, as a truncated funnel and can have a bottom surface 1550. In certain embodiments, the bottom surface 1550 can be mechanically coupled to a stationary plate, thereby embodying a stationary inner portion of the non-planar diaphragm 1510. Accordingly, in response to a pressure wave impinging onto the non-planar diaphragm 1510, the bottom surface 1550 can remain stationary (represented as null displacement vectors u=0) and other regions of the portion 1530 can deform elastically (represented as displacement vectors {u}).

Figure 16:
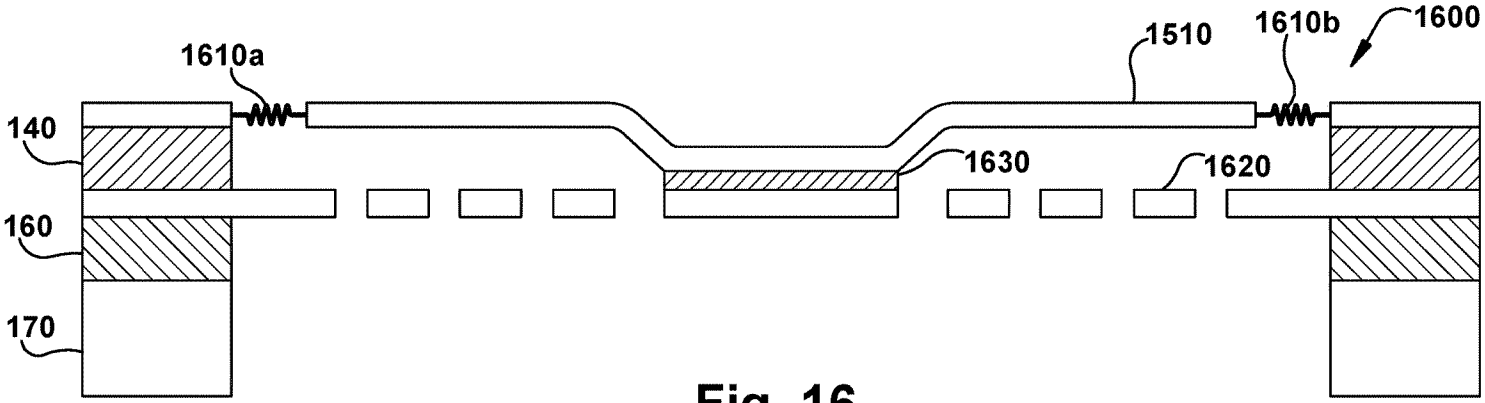
FIG. 16 illustrates a cross-sectional view of an example of a microelectromechanical microphone die in accordance with one or more embodiments of the disclosure.

As an illustration, in the microelectromechanical microphone 1600 shown in FIG. 16, the bottom surface 1550 can be rigidly mechanically coupled (e.g., attached) to a stationary plate 1620 via a dielectric member 1630. In one example, the dielectric member 1630 can have a thickness comparable to the thicknesses of other dielectric members described herein. As such, despite the dielectric member 1630 being extended rather than elevated (as is dielectric member 910, for example), the stress and/or strain introduced by the interfaces between the dielectric member 1630 and the diaphragm 1510 and the stationary plate 1620 can be contained. As described herein, containing the stress and/or strain in the manner described herein can permit the stationary plate 1620 and the diaphragm 1510 to move jointly. In addition, containing the stress and/or strain can avoid reaching critical load and ensuing buckling instability. Therefore, the cavity 1540 can provide greater mechanical stability than an elevated dielectric member. In addition, a portion of the diaphragm 1510 can be flexibly mechanically coupled (depicted with spring-line markings) to a dielectric member 140 that overlays, and is coupled to, a portion of the stationary plate 1620. Similar to other embodiments described herein, the dielectric member 1630 and the stationary slab 140 can include or can be formed from the same electrically insulating material, e.g., amorphous silicon, a semiconductor oxide, a nitride (e.g., silicon nitride), or the like. Further, the stationary plate 1620 can define openings and can be mechanically coupled to a dielectric member 160. In addition, the dielectric member 160 can be mechanically coupled to a substrate 170 that defines an opening configured to receive an acoustic wave including an audible acoustic wave and/or a supersonic acoustic wave.

Figure 17A:
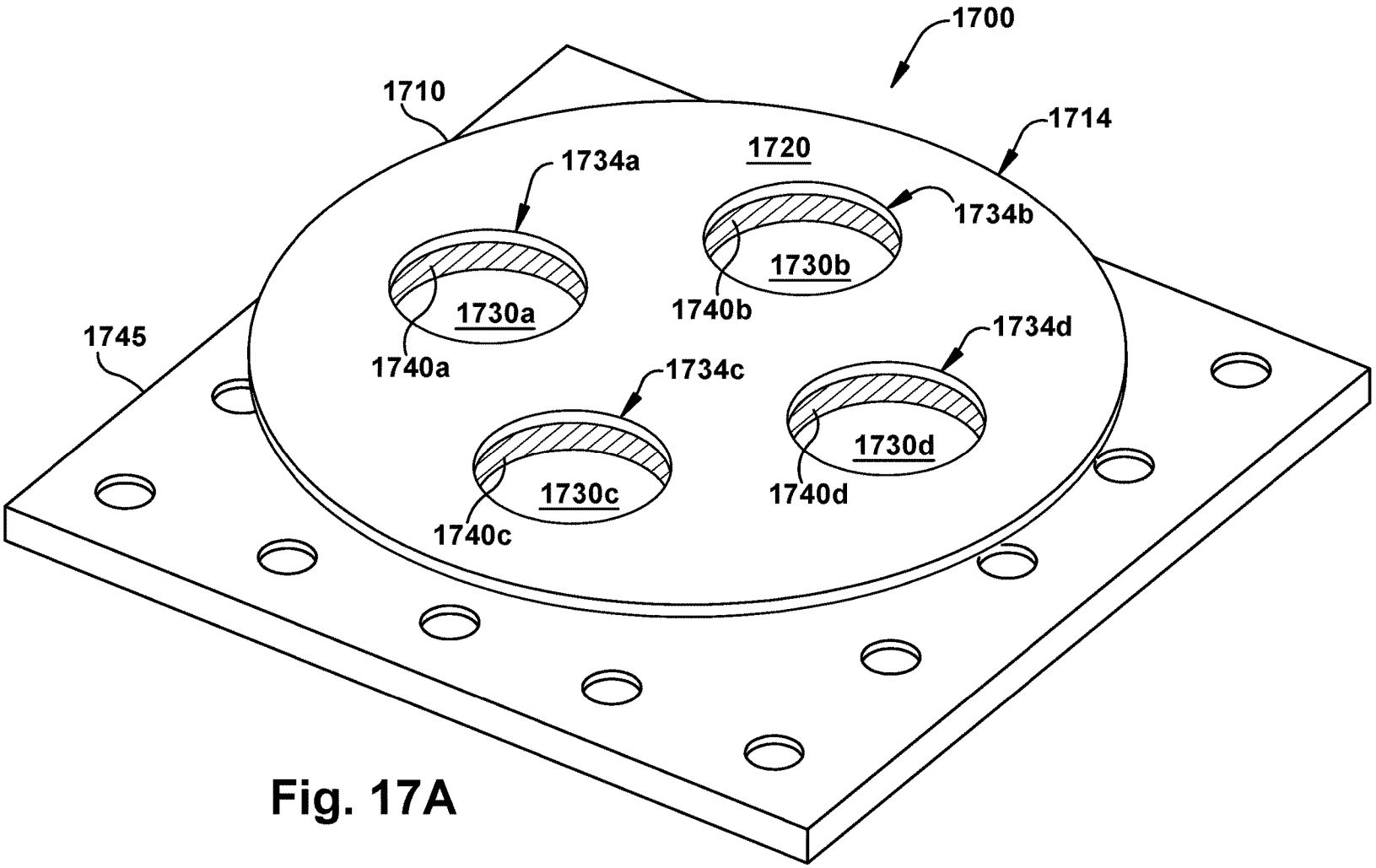
FIG. 17A illustrates a top perspective view of an example of a diaphragm in a microelectromechanical microphone in accordance with one or more embodiments of the disclosure.

Mechanical stabilization of a diaphragm in accordance with aspects of this disclosure can be scaled up to larger diaphragms (e.g., diameter ranging from about 400 μm to about 2000 μm) by introducing, for example, more than one stationary inner portion. Multiple stationary inner portions can provide greater mechanical support and/or design flexibility with respect to selection of materials and arrangements of the diaphragm and a backplate in order to achieve increased sensitivity and/or fidelity. In certain embodiments, such as the embodiment shown in FIG. 17A, a diaphragm 1710 can define an outer portion having a periphery 1714. In addition, the diaphragm 1710 can include a portion 1720 and can further define four openings 1730*a*-1730*d*, each defining respective circular peripheries 1734*a*-1734*d*. Portions of the diaphragm 1710, each including one of the circular peripheries 1734*a*-1734*d*, can be mechanically coupled to respective dielectric members 1740*a*-1740*d*. Each of the dielectric members 1740*a*-1740*d* can extend from a surface of the diaphragm 1710 to a surface of a stationary plate 1745. While four openings are depicted for the sake of illustration, it should be appreciated that this disclosure is not limited in that respect and a number of openings less than four or greater than four also is contemplated.

As illustrated, each of the dielectric members 1740*a*-1740*d* can define an inner curved surface having cylindrical symmetry. It should be appreciated that such dielectric members can define other type of inner surfaces and, in certain embodiments, each of the dielectric members 1740*a*-1740*d* can define an inner surface that is centrosymmetric—e.g., the inner surface can define a square section, a pentagonal section, a hexagonal section, an octagonal section, or the like.

Figure 17B:
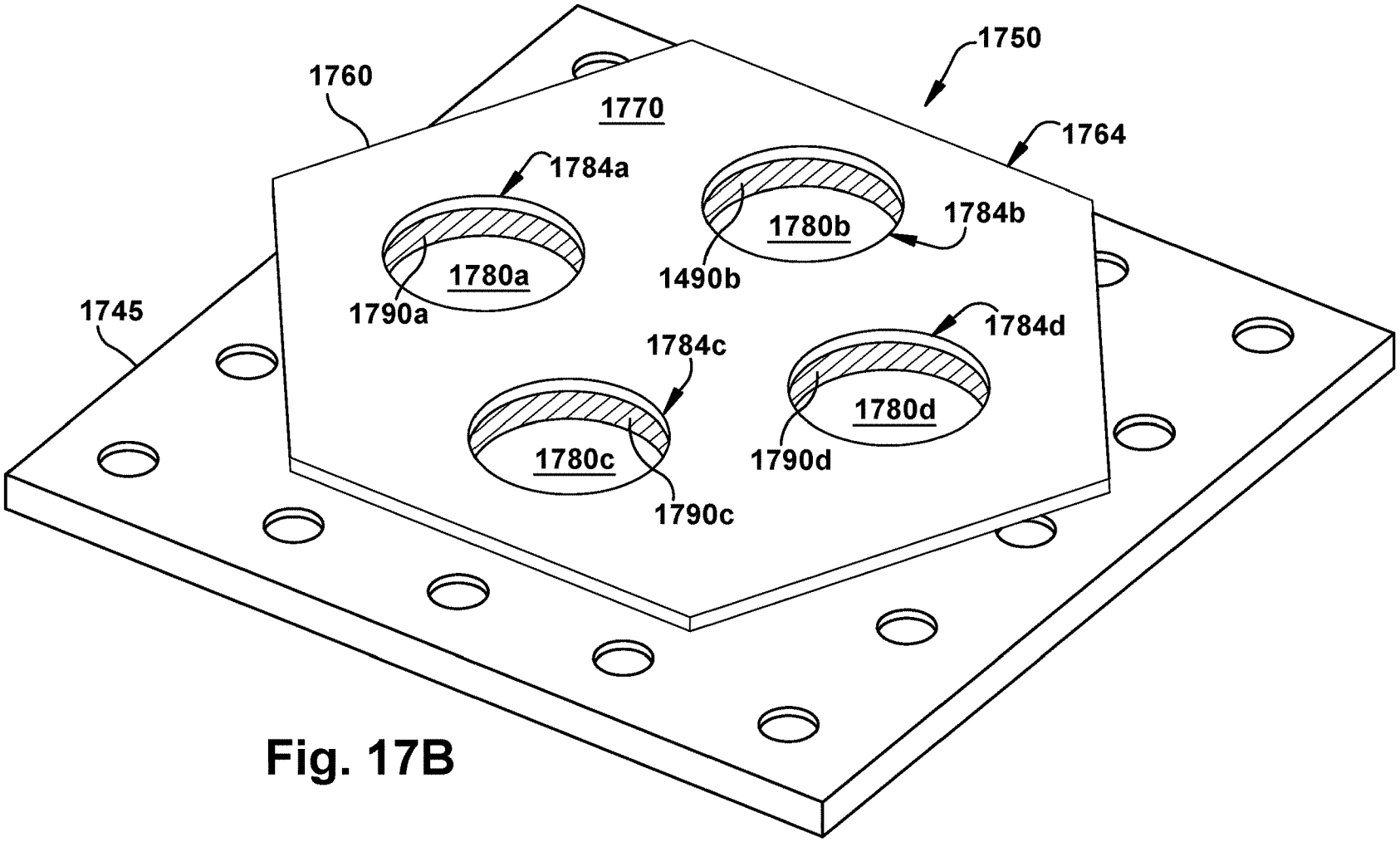
FIG. 17B illustrates a top perspective view of an example of a diaphragm in a microelectromechanical microphone in accordance with one or more embodiments of the disclosure.

In other embodiments, such as the embodiment shown in FIG. 17B, a diaphragm 1760 can define an outer portion having a periphery 1764. The diaphragm 1710 can include a portion 1770 and can further define four openings 1780*a*-1780*d*, each defining respective circular peripheries 1784*a*-1784*d*. Portions of the diaphragm 1760, each including one of the circular peripheries 1784*a*-1784*d*, can be mechanically coupled (e.g., attached) to respective dielectric members 1790*a*-1790*d*. Each of the dielectric members 1740*a*-1740*d* can extend from a surface of the diaphragm 1760 to a surface of a stationary slab 1745. In addition, in the illustrated example, each of the dielectric members 1790*a*-1790*d* can define an inner curved surface having cylindrical symmetry. It should be appreciated that such dielectric members can define other type of inner surfaces and, in certain embodiments, each of the dielectric members 1790*a*-1790*d* can define an inner surface that is centrosymmetric. For instance, the inner surface can define a square section, a pentagonal section, a hexagonal section, an octagonal section, or the like.

Figure 18A:
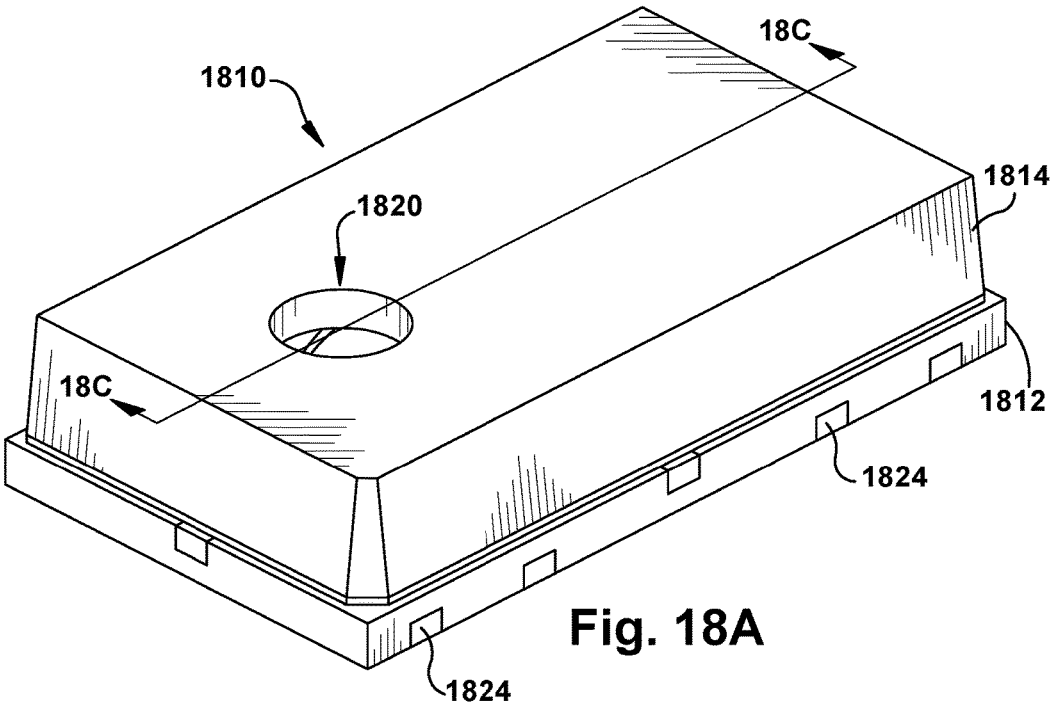
FIG. 18A illustrates a top perspective view of a packaged microphone having a microelectromechanical microphone die in accordance with one or more embodiments of the disclosure.

The microelectromechanical microphones having a stationary portion in accordance with this disclosure can be packaged for operation within an electronic device or other types of appliances. As an illustration, FIG. 18A presents a top, perspective view of a packaged microphone 1810 that can include a microelectromechanical microphone die in accordance with one or more embodiments of this disclosure (such as the microelectromechanical microphone die 100 shown in FIG. 1 and discussed herein). In addition, FIG. 18B presents a bottom, perspective view of the packaged microphone 1810.

As illustrated, the packaged microphone 1810 has a package base 1812 and a lid 1814 that form an interior chamber or housing that contains a microelectromechanical microphone chipset 1816. In addition or in other embodiments, such a chamber can include a separate microphone circuit chipset 1818. The chipsets 1816 and 1818 are depicted in FIGS. 18C and 18D and are discussed hereinafter. In the illustrated embodiment, the lid 1814 is a cavity-type lid, which has four walls extending generally orthogonally from a top, interior face to form a cavity. In one example, the lid 1814 can be formed from metal or other conductive material to shield the microelectromechanical microphone die 1816 from electromagnetic interference. The lid 1814 secures to the top face of the substantially flat package base 1812 to form the interior chamber.

As illustrated, the lid 1814 can have an audio input port 1820 that is configured to receive audio signals (e.g., audible signals and/or ultrasonic signals) and can permit such signals to ingress into the chamber formed by the package base 1812 and the lid 1814. In additional or alternative embodiments, the audio port 1820 can be placed at another location. For example, the audio port 1812 can be placed at the package base 1812. For another example, the audio port 1812 can be place at one of the side walls of the lid 1814. Regardless of the location of the audio port 1812, audio signals entering the interior chamber can interact with the microelectromechanical microphone chipset 1816 to produce an electrical signal representative of at least a portion of the received audio signals. With additional processing via external components (such as a speaker and accompanying circuitry), the electrical signal can produce an output audible signal corresponding to an input audible signal contained in the received audio signals.

Figure 18B:
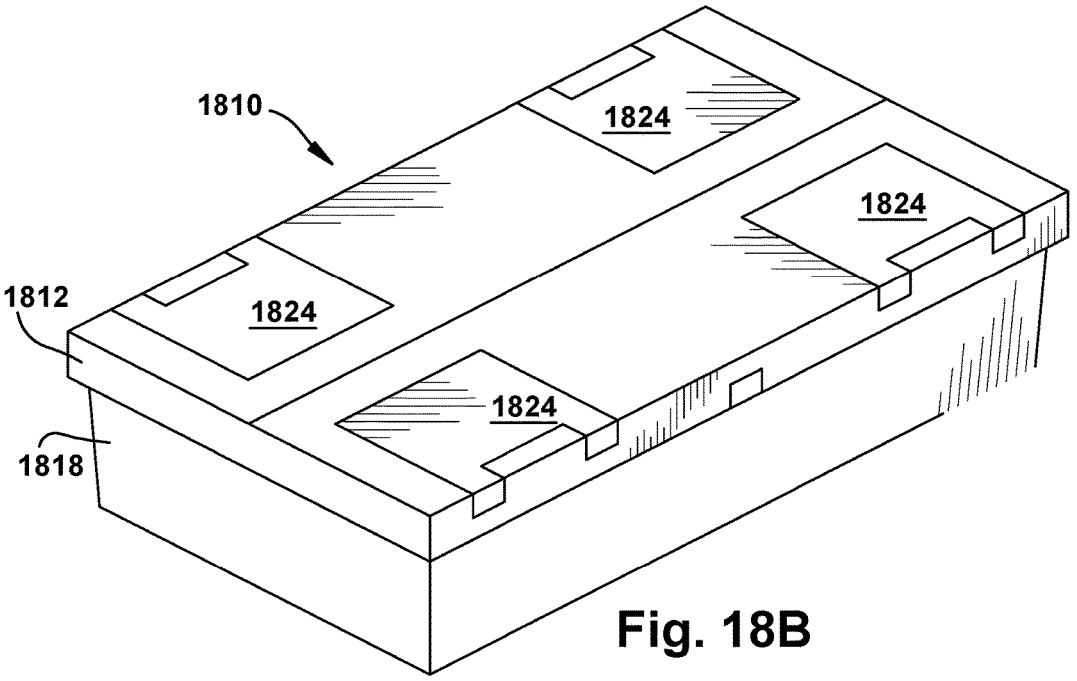
FIG. 18B illustrates a bottom perspective view of the packaged microphone shown in FIG. 18A.
Figure 18C:
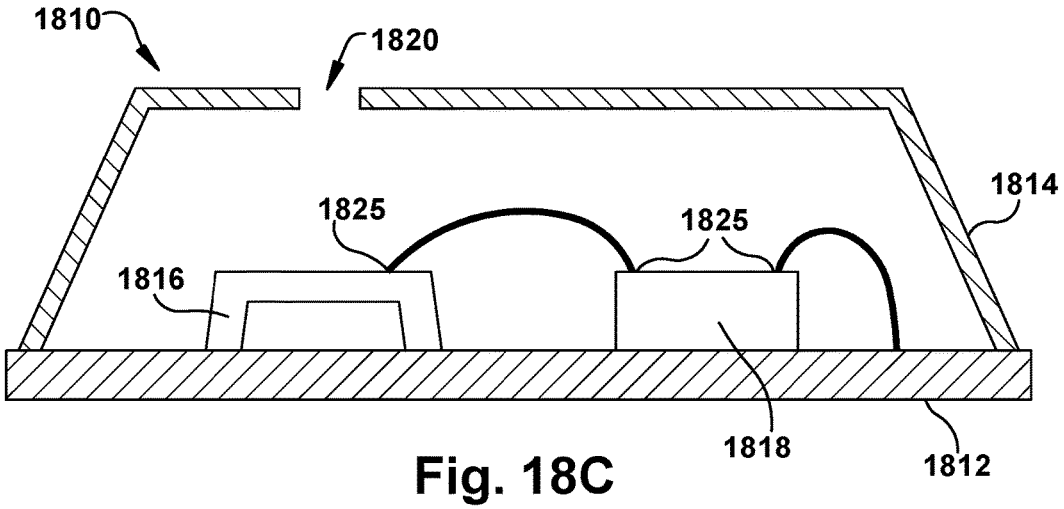
FIG. 18C illustrates a cross-sectional view of the packaged microphone shown in FIG. 18A.
Figure 18D:
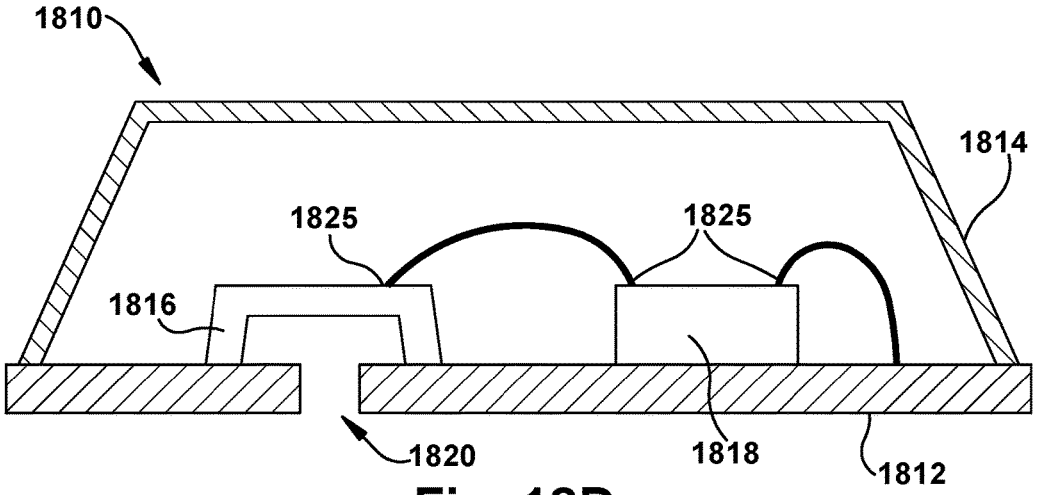
FIG. 18D illustrates a cross-sectional view of another example of a packaged microphone having a microelectromechanical microphone die in accordance with one or more embodiments of the disclosure.

FIG. 18B presents an example of a bottom face 1822 of the package base 1812. As illustrated, the bottom face 1822 has four contacts 1824 for electrically (and physically, in many use cases) connecting the microelectromechanical microphone chipset 1816 with a substrate, such as a printed circuit board or other electrical interconnect apparatus. While four contacts 1824 are illustrated, it should be appreciated that the disclosure is not limited in this respect and other number of contacts can be implemented in the bottom face 1822. The packaged microphone 1810 can be used in any of a wide variety of applications. For example, the packaged microphone 1810 can be used with mobile telephones, land-line telephones, computer devices, video games, hearing aids, hearing instruments, biometric security systems, two-way radios, public announcement systems, and other devices that transduce acoustic signals. In a particular, yet not exclusive, implementation, the packaged microphone 1810 can be used within a speaker to produce audible signals from electrical signals.

In certain embodiments, the package base 1812 shown in FIGS. 18A and 18B can be embodied in or can contain a printed circuit board material, such as FR-4, or a premolded, leadframe-type package (also referred to as a "premolded package"). Other embodiments may use or otherwise leverage different package types, such as ceramic cavity packages. Therefore, it should be appreciated that this disclosure is not limited to a specific type of package.

FIG. 18C illustrates a cross-sectional view of the packaged microphone 1810 across line 18C-18C in FIG. 18A. As illustrated and discussed herein, the lid 1814 and base 1812 form an internal chamber or housing that contains a microelectromechanical microphone chipset 16 and a microphone circuit chipset 1818 (also referred to as "microphone circuitry 1818") used to control and/or drive the microelectromechanical microphone chipset 1816. In certain embodiments, electronics can be implemented as a second, standalone integrated circuit, such as an application specific integrated circuit (e.g., an "ASIC die 1818") or a field programmable gate array (e.g., "FPGA die 1818"). It should be appreciated that, in certain embodiments, the microelectromechanical microphone chipset 1816 and the microphone circuit chipset 1818 can be formed on a single die.

Adhesive or another type of fastening mechanism can secure or otherwise mechanically couple the microelectromechanical microphone chipset 1816 and the microphone circuit chipset 1818 to the package base 1812. Wirebonds or other type of electrical conduits can electrically connect the microelectromechanical microphone chipset 1816 and microphone circuit chipset 1818 to contact pads (not shown) on the interior of the package base 1812.

While FIGS. 18A-18C illustrate a top-port packaged microphone design, certain embodiments can position the audio input port 1820 at other locations, such as through the package base 1812. For instance, FIG. 18D illustrates a cross-sectional view of another example of a packaged microphone 1810 where the microelectromechanical microphone chipset 1816 covers the audio input port 1820, thereby producing a large back volume. In other embodiments, the microelectromechanical microphone chipset 1816 can be placed so that it does not cover the audio input port 1820 through the package base 1812.

It should be appreciated that the present disclosure is not limited with respect to the packaged microphone 1810 illustrated in FIGS. 18A-18D. Rather, discussion of a specific packaged microphone is for merely for illustrative purposes. As such, other microphone packages including a microelectromechanical microphone having a stationary region in accordance with the disclosure are contemplated herein.

In the present specification, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in this specification and annexed drawings should generally be construed to mean "one or more" unless specified otherwise or clear from context to be directed to a singular form.

In addition, the terms "example" and "such as" are utilized herein to mean serving as an instance or illustration. Any embodiment or design described herein as an "example" or referred to in connection with a "such as" clause is not necessarily to be construed as preferred or advantageous over other embodiments or designs. Rather, use of the terms "example" or "such as" is intended to present concepts in a concrete fashion. The terms "first," "second," "third," and so forth, as used in the claims and description, unless otherwise clear by context, is for clarity only and doesn't necessarily indicate or imply any order in time.

What has been described above includes examples of one or more embodiments of the disclosure. It is, of course, not possible to describe every conceivable combination of components or methodologies for purposes of describing these examples, and it can be recognized that many further combinations and permutations of the present embodiments are possible. Accordingly, the embodiments disclosed and/or claimed herein are intended to embrace all such alterations, modifications and variations that fall within the spirit and scope of the detailed description and the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A microelectromechanical microphone, comprising:

a stationary plate comprising multiple openings; and a movable plate comprising an outer portion and an inner opening that is substantially centered at a geometric center of the movable plate, wherein the movable plate is rigidly attached, via a hollow dielectric member comprising a circular region corresponding to the inner opening and extending from a first surface of the stationary plate to a second surface of the movable plate, to the stationary plate in a vicinity of the inner opening to facilitate a reduction in buckling instability, wherein the hollow dielectric member comprises a substantially centrosymmetric shell comprising a thickness and comprising a dielectric cross-section, and wherein a ratio between a width of the dielectric cross-section and the thickness is in a range from about 3 to about 300.

2. The microelectromechanical microphone of claim 1, wherein the stationary plate comprises silicon, and wherein the movable plate comprises silicon.

3. The microelectromechanical microphone of claim 1, wherein each of the thickness and the width of the dielectric cross-section of the substantially centrosymmetric shell is based at least on a first material that forms the movable plate and a second material that forms the hollow dielectric member.

4. The microelectromechanical microphone of claim 1, wherein the outer portion comprises a first cross-section, and wherein the opening comprises a second cross-section.

5. The microelectromechanical microphone of claim 4, wherein the first cross-section is one of a first octagonal cross-section or a first circular cross-section, and wherein the second cross-section is one of a second octagonal cross-section or a second circular cross-section.

6. The microelectromechanical microphone of claim 5, wherein the ratio is a first ratio, and wherein a second ratio between a first radius of the first circular cross-section and a second radius of the second circular cross-section ranges from about 2 to about 10.

7. The microelectromechanical microphone of claim 1, wherein the dielectric cross-section comprises one of a circular cross-section, an oval cross-section, a square cross-section, a pentagonal cross-section, a hexagonal cross-section, a heptagonal cross-section, an octagonal cross-section, or a decagonal cross-section.

8. The microelectromechanical microphone of claim 1, wherein the dielectric cross-section comprises one of a first cross-section comprising a polygonal perimeter or a second cross-section comprising a non-polygonal perimeter.

9. The microelectromechanical microphone of claim 1, wherein the hollow dielectric member is a first dielectric member, wherein the movable plate is mechanically coupled to a layer proximate to the outer portion, and wherein a second dielectric member is attached to the stationary plate and overlays the layer.

10. The microelectromechanical microphone of claim 1, wherein the hollow dielectric member is a first dielectric member, wherein the movable plate is mechanically coupled to a layer proximate to the outer portion, and wherein the layer overlays a second dielectric member that is attached to the stationary plate.

11. The microelectromechanical microphone of claim 10, wherein the outer portion forms an interface with the layer.

12. The microelectromechanical microphone of claim 10, wherein the outer portion is flexibly coupled to the layer.

13. The microelectromechanical microphone of claim 1, wherein the stationary plate comprises one of amorphous silicon; polycrystalline silicon; crystalline silicon; germanium; an alloy of silicon and germanium; a compound containing silicon, germanium, and oxygen; a III-V semiconductor; a II-VI semiconductor; a dielectric material; or a combination of two or more of the foregoing.

14. The microelectromechanical microphone of claim 1, wherein the movable plate comprises one of amorphous silicon; polycrystalline silicon; crystalline silicon; germanium; an alloy of silicon and germanium; a compound containing silicon, germanium, and oxygen; a III-V semiconductor; a II-VI semiconductor; a dielectric material; or a combination of two or more of the foregoing.

15. The microelectromechanical microphone of claim 1, wherein the hollow dielectric member comprises one of silicon dioxide or silicon nitride.

16. A microelectromechanical microphone, comprising:

a stationary plate comprising multiple openings; and a movable plate comprising an outer portion and an inner opening substantially centered at a geometric center of the movable plate, wherein the movable plate is mechanically coupled to the stationary plate via hollow dielectric members extending from a first surface of the stationary plate to a second surface of the movable plate in a vicinity of a geometrical center of the movable plate to facilitate a reduction in buckling instability, wherein the hollow dielectric members comprise respective substantially centrosymmetric shells, wherein a hollow dielectric member of the hollow dielectric members comprises a thickness and a cross-section, and wherein a ratio between a width of the cross-section and the thickness is in a range from about 3 to about 300.

17. The microelectromechanical microphone of claim 16, wherein the outer portion comprises a circular cross-section, and wherein the hollow dielectric members are disposed in a circular arrangement.

18. The microelectromechanical microphone of claim 16, wherein the thickness is based at least on a first material that forms the movable plate and a second material that forms the hollow dielectric member.

19. A microelectromechanical microphone, comprising:

a stationary plate comprising multiple openings; and a movable plate rigidly attached to the stationary plate via a hollow dielectric member extending from a surface of the stationary plate to a surface of the movable plate in a vicinity of a geometric center of the movable plate to facilitate a reduction in collapse of an outer portion of the movable plate, wherein the hollow dielectric member comprises a core-shell structure comprising a shell of a dielectric material and a hollow core that is bounded by the shell, and wherein a ratio between a width of a cross-section of the hollow core and a thickness of the dielectric material is in a range from about 3 to about 300.

20. The microelectromechanical microphone of claim 19, wherein the shell of the dielectric material is substantially centrosymmetric.

21. The microelectromechanical microphone of claim 20, wherein the width is a first width, wherein the cross-section is a first cross section, wherein the movable plate comprises an outer portion having a second cross-section, and wherein a ratio between a second width of the second cross-section and the first width of the cross-section is less than about 10.

22. The microelectromechanical microphone of claim 20, wherein each of the thickness of the dielectric material and the width of the cross-section of the core-shell structure is based at least on a first material that forms the movable plate and a second material that forms the hollow dielectric member.

23. A device, comprising:

a microelectromechanical microphone comprising a substrate comprising a first opening configured to receive an acoustic wave, a stationary plate mechanically coupled to the substrate and comprising multiple openings, and a movable plate comprising an outer portion and a second opening substantially centered at geometric center of the movable plate, wherein the movable plate is rigidly attached to the stationary plate via a hollow member extending from a surface of the stationary plate to a surface of the movable plate in a vicinity of the second opening, and wherein a ratio between a width of a cross-section of the hollow member and a thickness of a material of the hollow member is in a range from about 3 to about 300; and a circuit coupled to the microelectromechanical microphone and configured to receive a signal indicative of a capacitance between the stationary plate and the movable plate, wherein the signal represents an amplitude of the acoustic wave.

24. The device of claim 23, wherein the hollow member comprises one of a hollow opening having one of a circular cross-section, a square cross-section, a pentagonal cross-section, a hexagonal cross-section, a heptagonal cross-section, or an octagonal cross-section, and wherein the hollow member comprises a portion formed from a dielectric material.

25. The device of claim 23, wherein the movable plate is mechanically coupled to a layer proximate to the outer portion, and wherein the layer overlays a dielectric member attached to the stationary plate.

26. The device of claim 23, further comprising a housing comprising the microelectromechanical microphone and the circuit.

27. The device of claim 26, wherein the microelectromechanical microphone is formed on a first die and the circuit is formed on a second die, and wherein the first die is electrically coupled to the second die.

28. The microelectromechanical microphone of claim 1, wherein the hollow dielectric member comprises silicon dioxide.

29. The device of claim 23, wherein the hollow member comprises silicon dioxide.

* * * * *